US011971242B1

(12) United States Patent
Major

(10) Patent No.: US 11,971,242 B1
(45) Date of Patent: Apr. 30, 2024

(54) UNIVERSAL SCOPE RINGS

(71) Applicant: Berry Mtn., Inc., Liverpool, PA (US)

(72) Inventor: Jarrod Burk Major, Liverpool, PA (US)

(73) Assignee: Berry Mtn., Inc., Liverpool, PA (US)

( * ) Notice: Subject to any disclaimer, the term of this patent is extended or adjusted under 35 U.S.C. 154(b) by 0 days.

(21) Appl. No.: 17/577,072

(22) Filed: Jan. 17, 2022

Related U.S. Application Data

(60) Provisional application No. 63/138,184, filed on Jan. 15, 2021.

(51) Int. Cl.
*F41G 1/387* (2006.01)
*F41G 11/00* (2006.01)

(52) U.S. Cl.
CPC ..... *F41G 1/387* (2013.01); *F41G 11/003* (2013.01)

(58) Field of Classification Search
CPC ..... F41G 1/387; F41G 11/003; F41G 11/38; F41G 11/001
See application file for complete search history.

(56) References Cited

U.S. PATENT DOCUMENTS 4,299,044 A * 11/1981 Johannsen ..... F41G 11/003 42/127
4,941,277 A * 7/1990 Lawlor ..... F41G 11/003 42/111
5,787,630 A * 8/1998 Martel ..... F41G 11/003 42/127
7,562,484 B2 * 7/2009 Kim ..... F41G 11/004 24/282
D632,753 S * 2/2011 Leighton ..... D22/109
8,683,732 B2 4/2014 Joplin
D713,921 S * 9/2014 Williams ..... D22/109
D715,393 S * 10/2014 Williams ..... D22/109
10,845,162 B2 * 11/2020 Geissele ..... F41G 11/003
11,249,383 B2 * 2/2022 Walker ..... F41G 11/003
2010/0071247 A1 * 3/2010 Holmberg ..... F41G 1/473 42/124
2012/0311909 A1 * 12/2012 Cheng ..... F41C 27/00 42/90
2014/0259854 A1 * 9/2014 Williams ..... F41G 11/003 42/124
2016/0363416 A1 * 12/2016 Klotz ..... F41C 27/00
(Continued)

OTHER PUBLICATIONS

Vortex(R) scope ring manufactured by Sheltered Wings, Inc. dba Vortex Optics, on sale more than one year prior to Jan. 15, 2021.

*Primary Examiner* — Michelle Clement
(74) *Attorney, Agent, or Firm* — Hooker & Habib, P.C.

(57) ABSTRACT

A scope ring for attaching a rifle scope to the rail of a mounting rail of an armament includes at least a pair of bases, the bases being configured to directly attach the scope ring to the rail at different scope ring heights. A kit for attaching a scope ring to the rail of a mounting rail of an armament includes a pair of scope rings, each scope ring including at least a pair of bases the bases being configured to directly attach the scope ring to the rail at different scope ring heights. The two scope rings can mount the scope at four different scope ring heights. An auxiliary rail can also provided that can attach directly to the rail of the mounting rail. The scope ring attaches directly onto the auxiliary rail to mount the scope ring at a greater scope ring height.

19 Claims, 20 Drawing Sheets

(56) References Cited

U.S. PATENT DOCUMENTS

| | | | | |
|---|---|---|---|---|
| 2020/0248986 | A1* | 8/2020 | Hancosky | F41G 11/003 |
| 2021/0302121 | A1* | 9/2021 | Saadon | F41C 23/14 |
| 2022/0049929 | A1* | 2/2022 | Chen | F41G 1/44 |

* cited by examiner

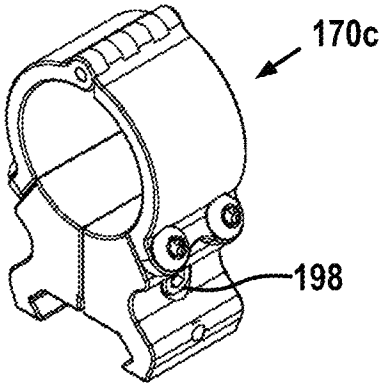
FIG. 67
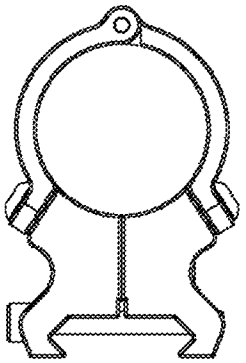
FIG. 68
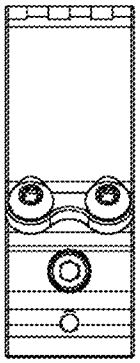
FIG. 69
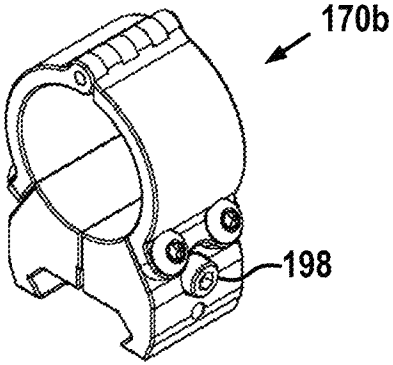
FIG. 64
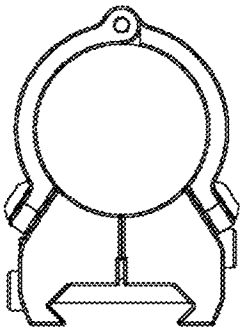
FIG. 65
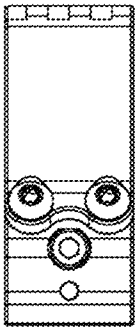
FIG. 66
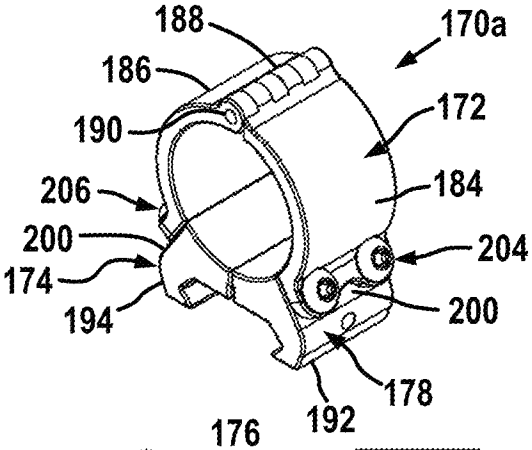
FIG. 61
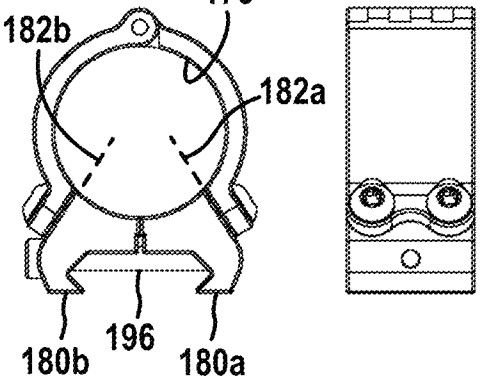
FIG. 62
FIG. 63

UNIVERSAL SCOPE RINGS

RELATED APPLICATION

This application claims priority to and the benefit of the filing date of U.S. Patent Application No. 63/138,184 filed Jan. 15, 2021 and titled Universal Scope Rings, the said priority application incorporated by reference as if fully set forth herein.

FIELD OF THE DISCLOSURE

The disclosure relates generally to accessories for long guns, and in particular, to scope rings.

BACKGROUND OF THE DISCLOSURE

Long guns such as rifles often include a mounting rail that mounts accessories onto the gun. The two most common and well-known mounting rails are the Picatinny rail (standardized by the US military as MIL-STD-1913) and the Weaver rail. A Picatinny rail has an elongate body defining an elongate hexagonal rail and a spacer that spaces the rail above the gun. The rail has a number of spaced-apart cross slots and flats that allow accessories to be attached to the rail. A Weaver rail is similar to a Picatinny rail but the slot shape and spacing is different. Generally speaking, an accessory that can be attached to a Weaver rail can be attached to a Picatinny rail, but the reverse is not always true.

A common accessory for a long gun is a rifle scope, a telescope used to provide a more accurate aim. A rifle scope can be mounted to the rail using a pair of scope rings that are attached to the rail and are spaced apart along the rail.

FIG. 73 illustrates a conventional scope ring 210, a VORTEX® scope ring manufactured by Sheltered Wings, Inc. dba Vortex Optics, Barneveld, Wisconsin. The scope ring includes a body 212 and a base 214. The body defines an interior circular scope through-hole 216 configured to securely receive and hold a cylindrical body tube of the rifle scope (not shown). The base mounts the body to the rail. The base includes a pair of opposed arms 218 extending away from a lower flat portion 220 of the body. The arms receive the rail between them with the body flat against the top of the rail.

The scope ring 210 is formed as a multi-component member to enable the scope ring to receive the rifle scope body and to secure the scope ring to the rail. The body 210 includes an upper body portion 222 removably secured by screws to a lower body portion 224. One of the arms 218 is removably attached to the lower body portion by screws.

Rifle scope bodies conventionally have an outer diameter of either one inch or thirty millimeters. Scope rings come with either a one-inch scope through-hole sized to closely receive the one-inch scope body or a thirty-millimeter scope through-hole sized to closely receive the thirty millimeter scope body.

The scope rings must mount the rifle scope a sufficient height above the rail for clearance of the bell (the portion of the rifle scope holding the objective lens). Scope rings that attach directly attach onto the rail of the mounting rail come in standard scope ring heights as measured vertically from the body flat to the center of the scope through-hole. Standardized scope ring heights may vary by manufacturer; an example of a standard set of scope ring heights (low, medium, high, and extra-high) that will be referred to in illustrative embodiments of the disclosed scope ring and scope ring system is:

low: 1 inch
medium: 1.1 inches
high: 1.3 inches
extra-high: 1.4 inches

A scope ring defining a scope mounting height as referred to herein refers to the vertical distance from the center of the scope through-hole to the top of the mounting rail and includes ant additional height of the scope ring above the mounting rail provided by an auxiliary rail (described in more detail below) is directly attached onto the mounting rail and the scope ring is indirectly attached to the mounting rail by being directly attached onto the auxiliary rail.

A person who wishes to mount a rifle scope to a long gun must select scope rings having the proper through-hole size and scope ring height for the rifle scope being mounted. Thus a retailer must stock scope rings in eight different combinations of scope through-hole size and scope ring height.

Furthermore, scope rings are provided in different finishes. A retailer offering scope rings in matte, polished, and anodized finishes in two different colors must inventory scope rings in 48 different combinations of through-hole size, ring height, and finish.

Thus there is a need for a scope ring that can reduce inventory demand.

SUMMARY OF THE DISCLOSURE

Disclosed are embodiments of a scope ring and embodiments of a scope ring system that includes a scope ring and an auxiliary rail, both the scope ring embodiments and the scope ring system embodiments enabling the scope ring to be mounted or attached to a mounting rail at selectively different scope ring heights without changing the scope ring itself. Thus a single scope ring can reduce scope ring inventory by being mountable to a compatible mounting rail at different scope ring heights.

A scope ring in accordance with this disclosure includes a body defining a scope through-hole that receives the body tube of the rifle scope, and a base having arms that attach the scope ring to a compatible rail of the mounting rail or auxiliary rail (auxiliary rails are described further below).

In a first set of embodiments the scope ring includes multiple bases that can each individually attach the scope ring to the rail of a mounting rail or auxiliary rail. Each base defines a respective different scope ring height when attaching the scope ring to the rail.

An embodiment of a multiple-base scope ring includes a first base and a second base. The first base mounts the scope ring to the rail at a relatively lower scope ring height. The second scope ring mounts the scope rail at a relatively greater scope ring height. For example, the first base mounts the scope ring at a low scope ring height and the second base mounts the scope ring at a high scope ring height when attached directly onto a mounting rail. Thus a retailer need only stock one scope ring to satisfy the need for two different scope ring heights.

A second embodiment of the multiple-base scope ring includes three bases in which each base defines a different respective scope ring height when attaching the scope ring directly onto a mounting rail. For example, a first base defines a low scope ring height, a second base defines a medium scope ring height, and a third base defines a high scope ring height when mounting the scope ring directly onto a mounting rail. Thus a retailer need only stock one scope ring to satisfy the need for three different scope ring heights.

In a second set of embodiments the scope ring forms part of a scope ring system that further includes a separate auxiliary rail. The auxiliary rail includes its own rail and base. The cross-section of the rail of the auxiliary rail is configured to be like the corresponding cross-section of the rail of the mounting rail compatible with the scope ring. The base of the auxiliary rail is configured to mount the auxiliary rail directly onto a rail of a mounting rail compatible with the scope ring. Thus the scope ring can be attached directly onto either the auxiliary rail or the mounting rail and the auxiliary rail can be attached directly onto the mounting rail.

When the scope ring base attaches the scope ring directly onto the rail of a mounting rail, the scope ring defines a first scope ring height. When the scope ring base attaches the scope ring directly onto the rail of an auxiliary rail that in turn is attached directly onto the mounting rail, the auxiliary rail raises the scope ring away from the rail of the mounting rail and defines a second scope ring height greater than the first scope ring height. Thus by selectively opting to attach the scope ring directly onto the mounting rail or indirectly onto the mounting rail through an auxiliary rail, the same scope ring can define multiple scope heights.

In another embodiment of the scope ring system, the scope ring has a single base and the system includes multiple auxiliary rails. When the scope ring is attached directly to the rail of the mounting rail by its base, the scope ring defines a low scope ring height. When the scope ring is attached to one of the auxiliary rails which in turn is attached directly to the rail of the mounting rail, the scope ring defines an increased scope ring height. Auxiliary rails can be provided that when individually used to indirectly mount the scope ring to the mounting rail selectively define medium, high, and extra-high scope ring heights. Thus a retailer can stock a scope ring system of single-base scope rings and different height auxiliary rails that enable mounting a scope ring to a mounting rail at all four standard scope heights.

Alternatively, auxiliary rails can themselves be stacked to further increase scope ring height as compared to attaching the scope ring to the mounting rail directly.

In an additional embodiment of the scope ring system, the scope ring has a pair of bases, a first, shorter base and a second, taller base. The system further includes a single auxiliary rail. When the scope ring is attached directly to the mounting rail using the first base, the scope ring defines a low scope ring height. When the scope ring is attached directly to the mounting rail using the second base, the scope ring defines a medium scope ring height. When the auxiliary rail is attached to the mounting rail and the scope ring is attached to the auxiliary rail using the first base, the scope ring defines a high scope ring height. When the auxiliary rail is attached to the mounting rail and the scope ring is attached to the auxiliary rail using the second base, the scope ring defines an extra-high scope ring height. Thus a retailer can stock a scope ring system of single scope rings and auxiliary rails that can mount the scope ring on a mounting rail at all four standard scope heights.

In a yet additional embodiment of the scope ring system, the scope ring has three bases that, when mounting the scope ring directly to the mounting rail, has the scope ring defining a low scope ring height, a medium scope ring height, and a high scope ring height. The system further includes a single auxiliary rail. When the auxiliary rail is attached directly to the mounting rail, each base of the scope ring can be attached to the auxiliary rail to define a medium scope ring height, a high scope ring height, and an extra-high scope ring height respectively. Thus a retailer can stock a scope ring system made of three-base scope ring and auxiliary rails that can mount the scope ring to a mounting rail at the four standard scope heights.

In a still further embodiment of the scope ring system, the system can include first two-base scope rings that define first and second scope ring heights when attached directly onto a mounting rail, and second two-base scope rings that define third and fourth scope ring heights when attached directly onto a mounting rail. For example, the first scope ring has bases defining low scope height and medium scope height and the second scope ring has bases defining high scope height and extra-high scope ring height. A retailer need only stock the first and second scope rings to have scope rings that can selectively mount a rifle scope at any of the four standard scope heights.

In a yet additional embodiment of the scope ring system, a multi-base scope ring can be formed of separate component parts that each include a respective base of the scope ring. Component parts are provided that provide a low base, a medium base, a high base, and an extra-high base when used to mount the scope ring to a mounting rail. The user can choose to assemble the scope ring using only the component parts for the desired scope height to mount one rifle scope to a mounting rail, and can later swap out one component part of the scope ring for another to exchange one base associated with one scope height for a different base associated with a different scope height. A retailer need only stock the component parts that can make up the scope ring to enable a user to selectively mount a rifle scope to a mounting at any of the four standard scope heights by exchanging one base component with another base component.

Other embodiments of the multiple-base scope ring may define different scope ring heights than the embodiments expressly described above.

The retailer stocking the disclosed multiple-base scope ring or scope ring systems with one or more auxiliary rails in many cases can stock scope rings without regard to height since the disclosed multi-base scope ring and scope ring systems offer multiple scope ring heights that can mount most rifle scopes. Inventory requirements are simplified. Customers can purchase the disclosed multiple-base scope ring or scope ring system knowing one of the scope ring heights will be correct for her or his rifle scope. Different rifle scopes can be used with the long gun without the need to have different height scope rings on hand when changing rifle scopes.

Other objects and features of the disclosure will become apparent as the description proceeds, especially when taken in conjunction with the accompanying drawing sheets illustrating one or more illustrative embodiments.

BRIEF DESCRIPTION OF THE DRAWINGS

FIGS. 61-63 are perspective, front, and side view of an eighth embodiment, single-base scope ring in accordance with this disclosure.

FIGS. 64-66 are perspective, front, and side view of a variant embodiment of the scope ring shown in FIG. 61.

FIGS. 67-69 are perspective, front, and side view of a second variant embodiment of the scope ring shown in FIG. 61.

DETAILED DESCRIPTION

Figures 1, 2, 3, 4:
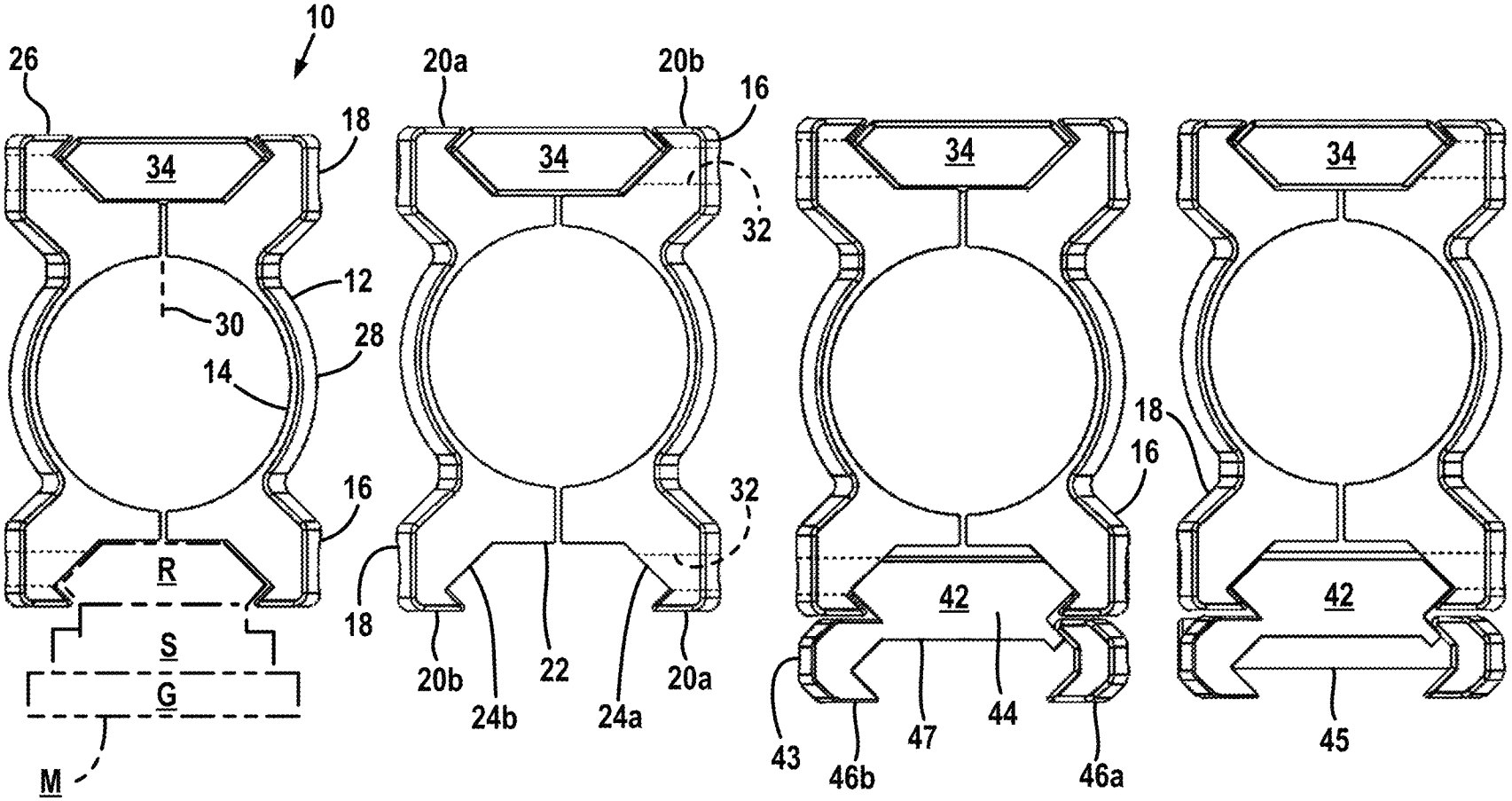
FIGS. 1 and 2 are front views of a first embodiment two-base scope ring in accordance with this disclosure mounted on a mounting rail, the scope ring as shown in FIG. 2 reversed vertically on the mounting rail from FIG. 1.
FIGS. 3 and 4 are similar to FIGS. 1 and 2 but illustrate the scope ring mounted on an auxiliary rail that is mounted directly on the mounting rail

FIGS. 1 and 2 illustrate a first embodiment scope ring 10 in accordance with this disclosure for mounting a rifle scope to a long gun. The scope ring 10 includes a body 12 defining an interior circular scope through-hole 14, the through-hole 14 being configured to securely receive and hold a cylindrical body tube of the rifle scope (not shown). The scope ring 10 includes two bases, a first, shorter base 16 and a second, taller base 18. Each base 16, 18 is attached to and extends radially away from the center of the body scope through-hole 14. The bases 16, 18 are disposed 180 degrees apart from one another on opposite sides of the through-hole 14.

In the illustrated embodiment each base 16, 18 is configured to mount the scope ring directly onto a Picatinny rail or a Weaver rail. The bases 16, 18 in alternative embodiments may be configured to mount the scope ring 10 onto only a Picatinny rail, only a Weaver rail, or some other style mounting rail.

Each base 16 and base 18 includes a pair of base arms 20*a*, 20*b* extending from opposite ends of a flat surface 22. Each arm 20 has an inner, inclined flat surface 24 extending towards the other arm. The flat surface 22 and the arm flat surfaces 24*a*, 24*b* are configured to receive and contact corresponding surfaces of the rail of the mounting rail to secure and retain the base on the mounting rail.

The base 16 defines a first or shorter base that defines a first, lower scope ring height when attaching the scope ring 10 to the mounting rail. The base 18 defines a second or taller base that defines a second, greater scope ring height greater than the first scope ring height when attaching the scope ring to the mounting rail.

The illustrated scope ring 10 is designed such that the base 16 mounts the scope at a scope ring height of one inch (low) and the base 18 mounts the scope at a scope ring height of 1.1 inches (medium) when mounting the scope ring directly onto the mounting rail. The bases can be adapted for conformity with other standardized scope ring height systems.

FIG. 1 illustrates the base 16 attaching the scope ring 10 to a mounting rail M of a long gun G, the rail and long gun shown representationally in the figure. The mounting rail M includes a rail R and a spacer S that spaces the rail R above the long gun G. The base 16 mounts the scope ring 10 directly onto the rail R and spaces the scope through-hole 14 at the low scope ring height above the mounting rail.

FIG. 2 illustrates the base 18 attaching the scope ring 10 onto the rail R (to simplify the drawings, the mounting rail and the long gun are shown only in FIG. 1). The base 18 spaces the rifle scope at the medium scope ring height above the mounting rail. The scope ring height can be changed between low and medium merely by changing which base 16, 18 attaches the scope ring 10 directly onto the mounting rail.

The scope ring 10 is a multi-component member to enable receiving the scope body tube and mounting the scope ring onto the mounting rail. The scope ring 10 is formed from a left component half 26 (shown separately in FIGS. 7-10) and a right component half 28 (shown separately in FIGS. 11-14). The component halves 26, 28 are substantially mirror images of each other along a parting plane 30. The parting plane extends in the vertical direction, that is, it intercepts and extends along the rail R when the scope ring 10 is attached to the rail.

The component halves 26, 28 are held together by screws (not shown) extending through a partially threaded screw hole 32 included in each base 16, 18. The screw passing through the base 16 or the base 18 being used to attach the scope ring 10 to the rail also passes through a slot or hole in the mounting rail that locates the scope ring along the mounting rail. Each screw extends through one arm 20*a* and is threaded into the other arm 20*b* of the base 16 or the base 18 carrying the screw.

Figure 16:
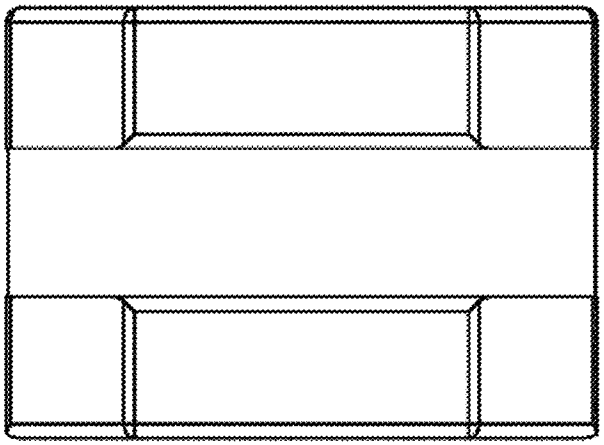
Figure 18:
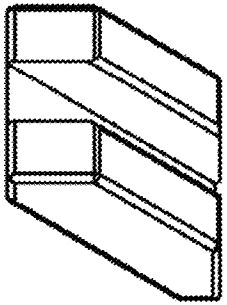
Figure 17:
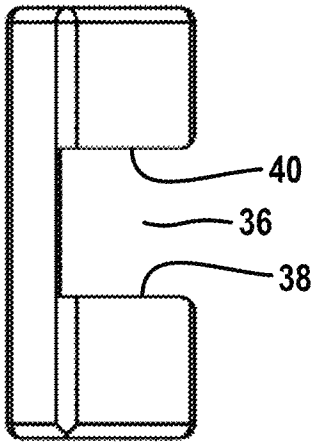
Figure 19:
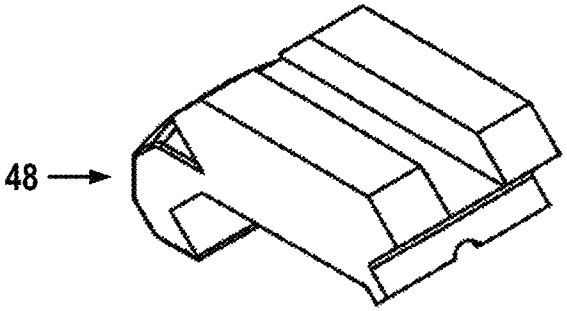
FIGS. 19-22 are perspective, front, and opposite side views respectively of the main component of the auxiliary rail shown in FIG. 3.

FIGS. 1 and 2 illustrate a first auxiliary plug 34 (shown separately in FIGS. 16-18) being received between the arms of the base 18 (FIG. 1) or the base 16 (FIG. 2) not attaching the scope ring 10 to the rail. The plug 34 has the same cross-section as the rail R and substantially fills the space between the arms of the base that would otherwise be taken up by the rail R if the base were attaching the scope ring to the rail R. The plug 34 is held in the base 16 or the base 18 by one of the screws fastening together the component halves 26, 28. The screw passes through a slot or hole 36 formed in the plug 34 that is bounded by facing plug walls 38, 40 (see FIG. 17). The base arms, the plug walls, and the screw capture the plug in the base between the base arms 20 as shown in the figures. The plug 34 cooperates with the tops of the base arms 20 to define an essentially flat surface at the top of the scope ring 10 away from the rail.

Figure 5:
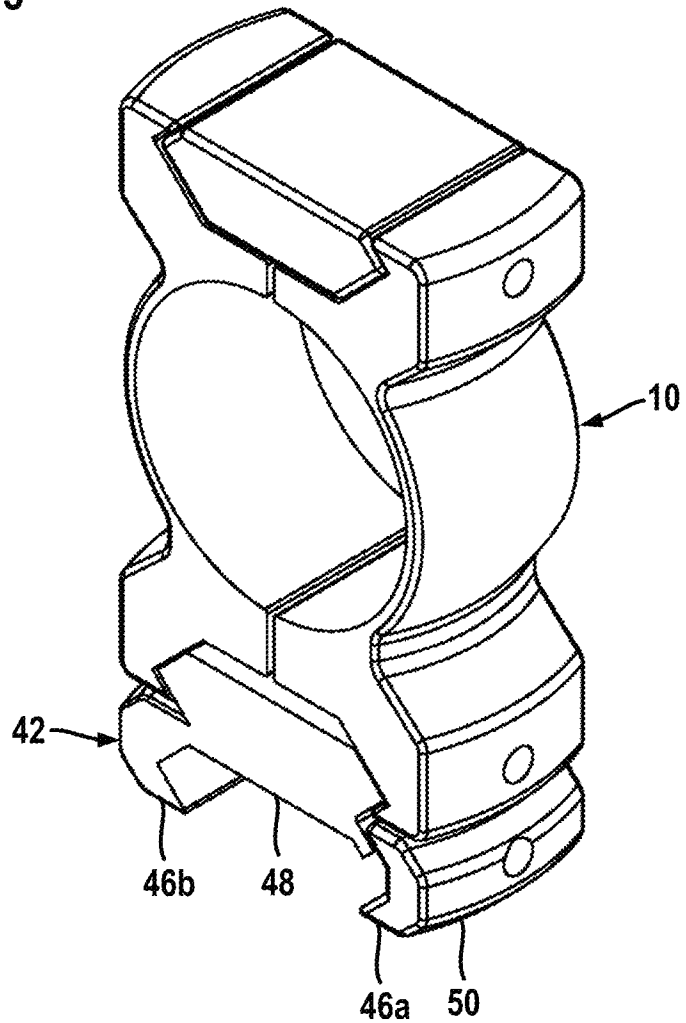
FIG. 5 is a perspective view of the scope ring shown in FIG. 1.
Figure 7:
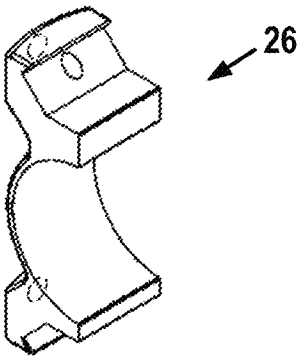
FIGS. 7 and 8 are perspective and front views respectively of one of the component halves of the scope ring shown in FIG. 1.
Figure 10:
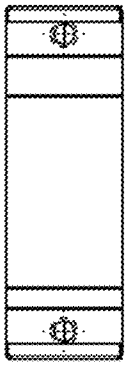
FIG. 10 is a side view of the one component half shown in FIG. 8.
Figure 9:
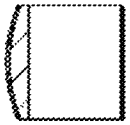
FIG. 9 is a sectional view of the one component half taken along line A-A of FIG. 8.
Figure 8:
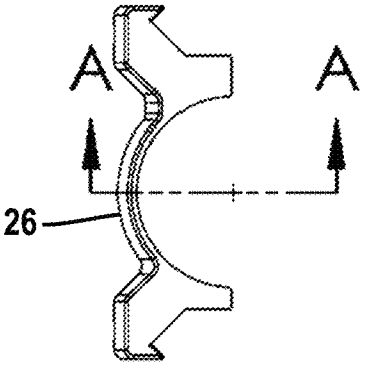
Figure 11:
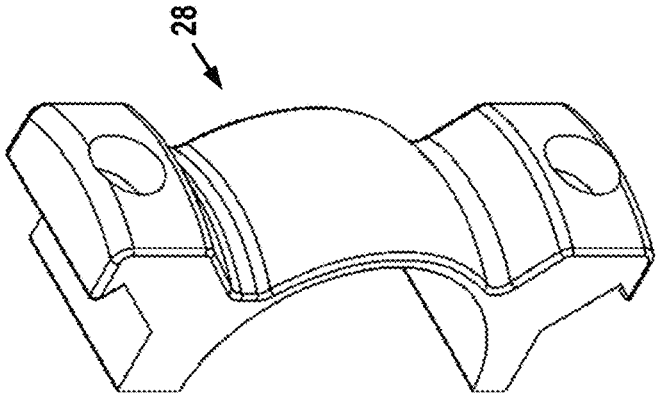
FIGS. 11-14 correspond to FIGS. 7-10 but of the other component half of the scope ring shown in FIG. 1.
Figure 14:
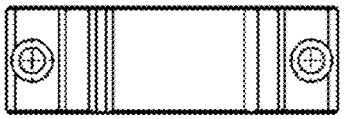
Figure 13:
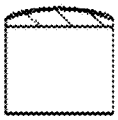
Figure 12:
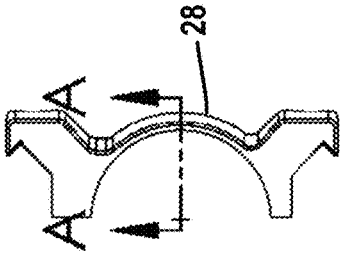
Figure 15:
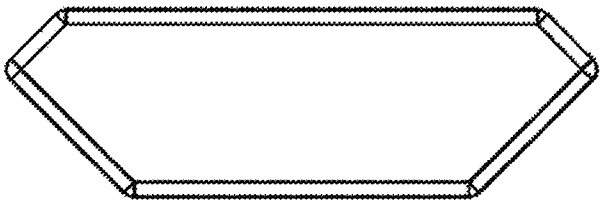
FIGS. 15-18 are front, bottom, side, and perspective views respectfully of the auxiliary plug shown in FIG. 1.

FIGS. 3-5 are similar to FIGS. 1 and 2 but illustrate an auxiliary rail 42 indirectly attaching the scope ring 10 to the rail R The auxiliary rail 42 includes a rail portion or rail 44 that is generally similar in cross-section to the rail R and a base portion or base 43 extending away from the rail 44. The rail 44 functions as a rail of a one-slot Picatinny rail or Weaver rail that enables a base 16 or base 18 of the scope ring 10 to attach directly onto the rail 44 of the auxiliary rail 42. The base 43 of the auxiliary rail 42 is similar to the base 16 or the base 18 in being configured to receive and attach the auxiliary rail 42 directly onto the rail R.

The auxiliary rail base 43 includes a pair of arms 46*a*, 46*b* extending away from opposite ends of a bottom flat surface 47. The arms 46 and the flat surface 47 retain and secure the auxiliary rail 42 directly onto the rail R in the same way as previously described for the base 16 and the base 18.

The rail 44 of the auxiliary rail 42 enables the scope ring base 16 or the scope ring 18 to attach directly onto the rail 44 for attaching the scope ring 10 onto the auxiliary rail 42 in the same manner as the base 16 or the base 18 attaches the scope ring 10 directly onto the rail R.

The scope ring base 16 directly attaches onto the auxiliary rail 42 as shown in FIG. 3 to attach the scope ring 10 indirectly onto the rail R. The base 16 and the auxiliary rail 42 cooperatively define a third scope ring height above the mounting rail M that is greater than the first scope ring height.

The scope ring base 18 attaches the scope ring 10 to the auxiliary rail 42 as shown in FIGS. 4 and 5 to indirectly attach the scope ring 10 to the rail R. The base 18 and the auxiliary rail 42 cooperatively define a fourth scope ring height that is greater than the second scope ring height.

The auxiliary rail 42 is a multi-component member in which one arm is removably attached to the remainder of the auxiliary rail. The removable arm is removed to enable mounting the auxiliary rail directly onto the mounting rail.

Figure 20:
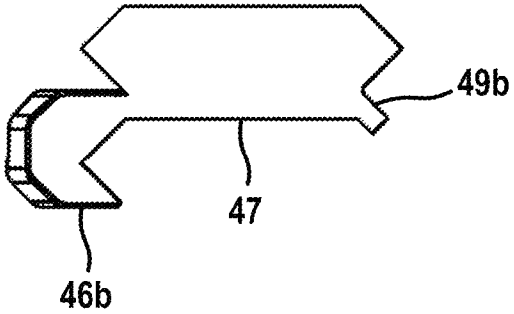
Figure 21:
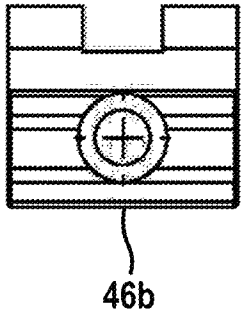
Figure 22:
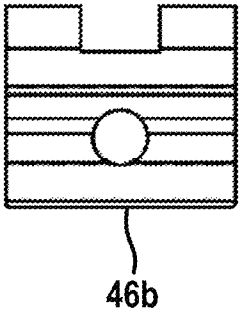
Figure 23:
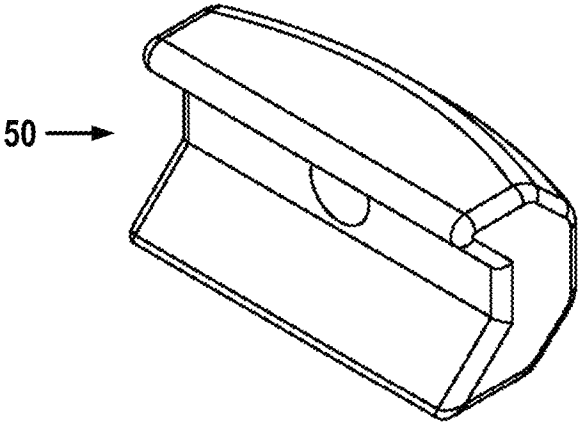
FIGS. 23-26 are perspective, front, top, and side views respectively of the removable arm component of the auxiliary rail shown in FIG. 3.
Figure 26:
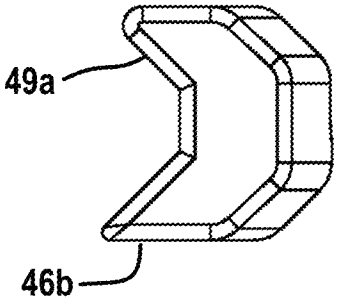
Figure 25:
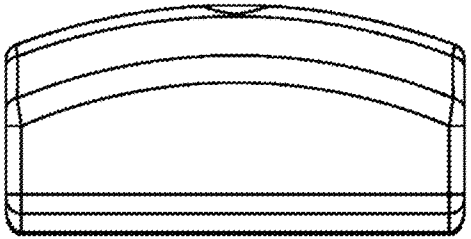
Figure 24:
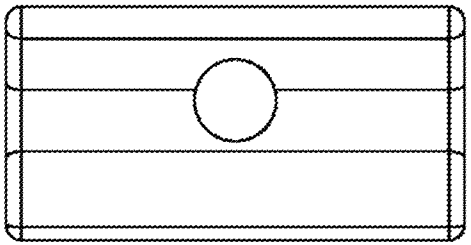
Figure 30:
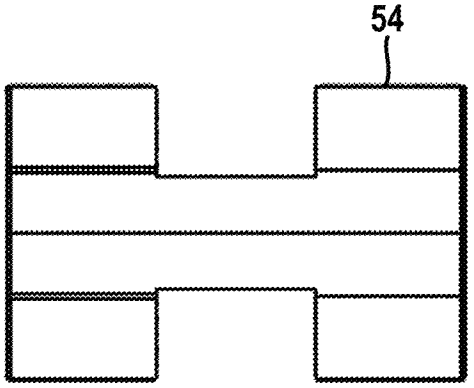
FIGS. 27-30 are perspective, front, bottom, and side views respectively of the second embodiment auxiliary plug shown in FIG. 6.
Figure 27:
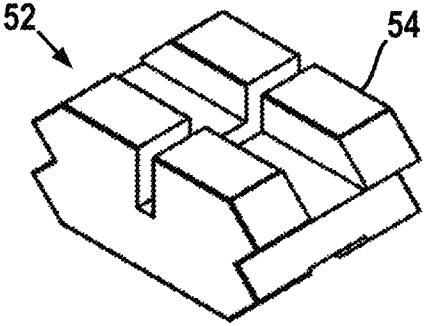
Figure 28:
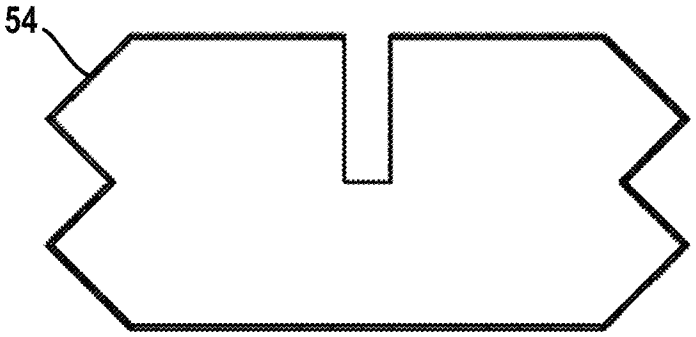
Figure 29:
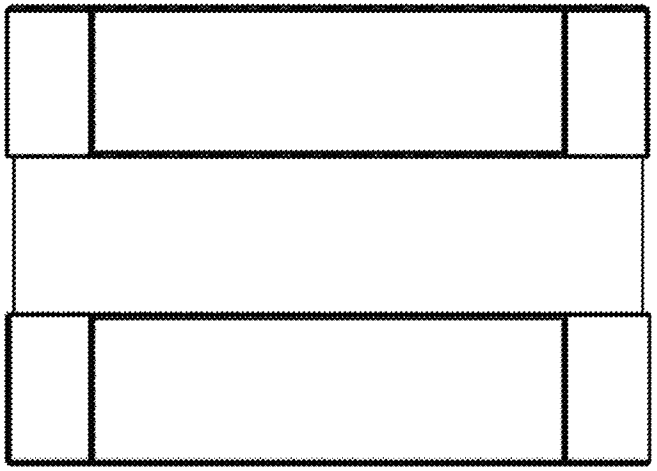

The auxiliary rail 42 is formed with a main component 48 (see FIG. 5 and shown separately in FIGS. 19-22) and an arm component 50 (see FIG. 5 and shown separately in FIGS. 23-26). The main component 48 includes one of the arms 46 and an the arm component 50 includes the other arm 46. The auxiliary rail components 48, 50 are held together by a screw 45 (see FIG. 4) extending through one arm 46*a* and threaded into the other arm 46*b* of the auxiliary rail 42. The screw 45 also passes through a slot in the rail when attaching the scope ring 10 to the rail. The screw 45 presses an abutment surface 47 of the arm component 50 against a cooperating abutment surface 49 of the main component 48 to secure the components 48, 50 together. See FIGS. 20 and 26.

The screw in the base 16 or the base 18 attaching the rail 44 of the auxiliary rail 42 to the base 16 or the base 18 passes through the same base screw holes used in fastening the base 16 or the base 18 directly to the rail. The screw passes through a slot or hole formed in the rail 44 that is similar to the slot or hole 36 formed in a plug 34.

The illustrated auxiliary rail 42 is designed for use with the exemplar standard scope ring heights to increase the scope ring height of an attached scope ring by three-tenths of an inch. Auxiliary rails for other standardized scope ring height systems may be modified for use in such other systems.

As a result, the scope ring 10 and the auxiliary rail 42 as illustrated in FIGS. 1-4 are sized to define respectively, a low scope ring height (the scope ring 10 attached directly onto the rail R by the base 16), a medium scope ring height (the scope ring 10 attached directly onto the rail R by the base 18), a high scope ring height (the auxiliary rail 42 attached directly onto the rail R and the scope ring 10 attached directly onto the auxiliary rail 42 by the scope ring base 16), and an extra-high scope ring height (the auxiliary rail 42 attached directly onto the rail R and the scope ring 10 attached directly onto the auxiliary rail 42 by the scope ring base 18).

A retailer need only stock scope rings 10 and auxiliary rails 42 to offer a scope ring system of a scope ring and an auxiliary rail that can be used for selectively attaching the scope ring to a compatible mounting rail at all four standard scope ring heights. The retailer can sell consumers a scope ring kit that includes the scope ring 10 and an auxiliary rail 42 to enable attaching the scope ring 10 to a mounting rail at low, medium, high, and extra-high scope heights.

Figure 6:
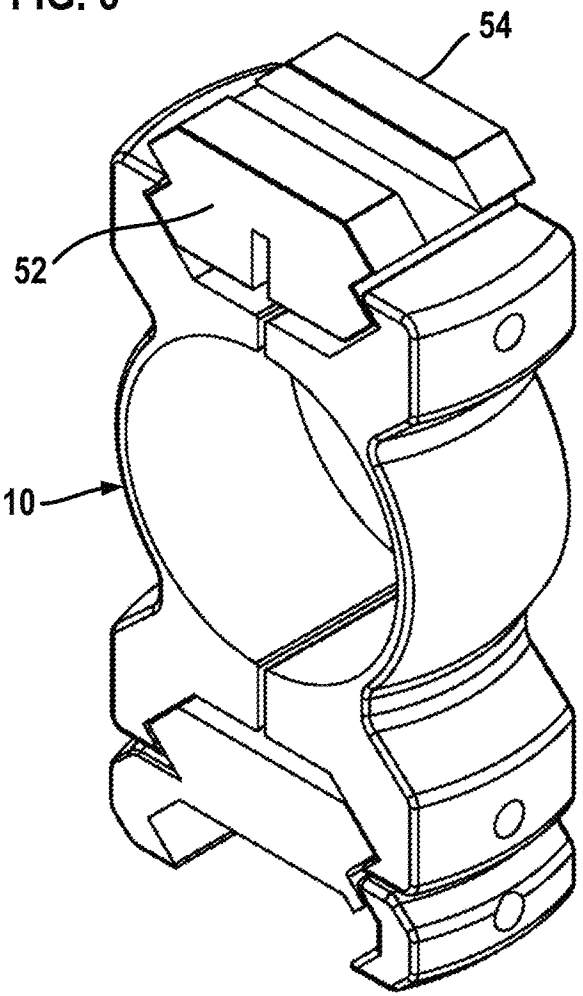
FIG. 6 is similar to FIG. 5 but illustrates the scope ring carrying a different embodiment auxiliary plug.

FIG. 6 is similar to FIG. 5 but illustrates use of a second embodiment auxiliary plug 52 (shown separately in FIGS. 27-30) instead of the first embodiment auxiliary plug 34. The second embodiment auxiliary plug 52 is similar to the first embodiment auxiliary plug 34 but further includes a rail 54 extending out of the base. The rail 54 is configured as a one-slot Picatinny/Weaver rail for attaching auxiliary components onto the scope ring 10 and therefore to the long gun mounting the scope ring.

Note that when the scope ring 10 is directly mounted on the rail R, the auxiliary rail 42 can also be mounted on the mounting rail R below the rifle scope if there is sufficient clearance. If there is not sufficient clearance, the auxiliary rail 42 can be mounted and held in the unused shorter base 16 or taller base 18 of the scope ring 10. The auxiliary plug 34, if also present, can be held in the base 43 of the auxiliary rail 42 held in the unused scope ring base.

Figures 31, 32, 33, 34:
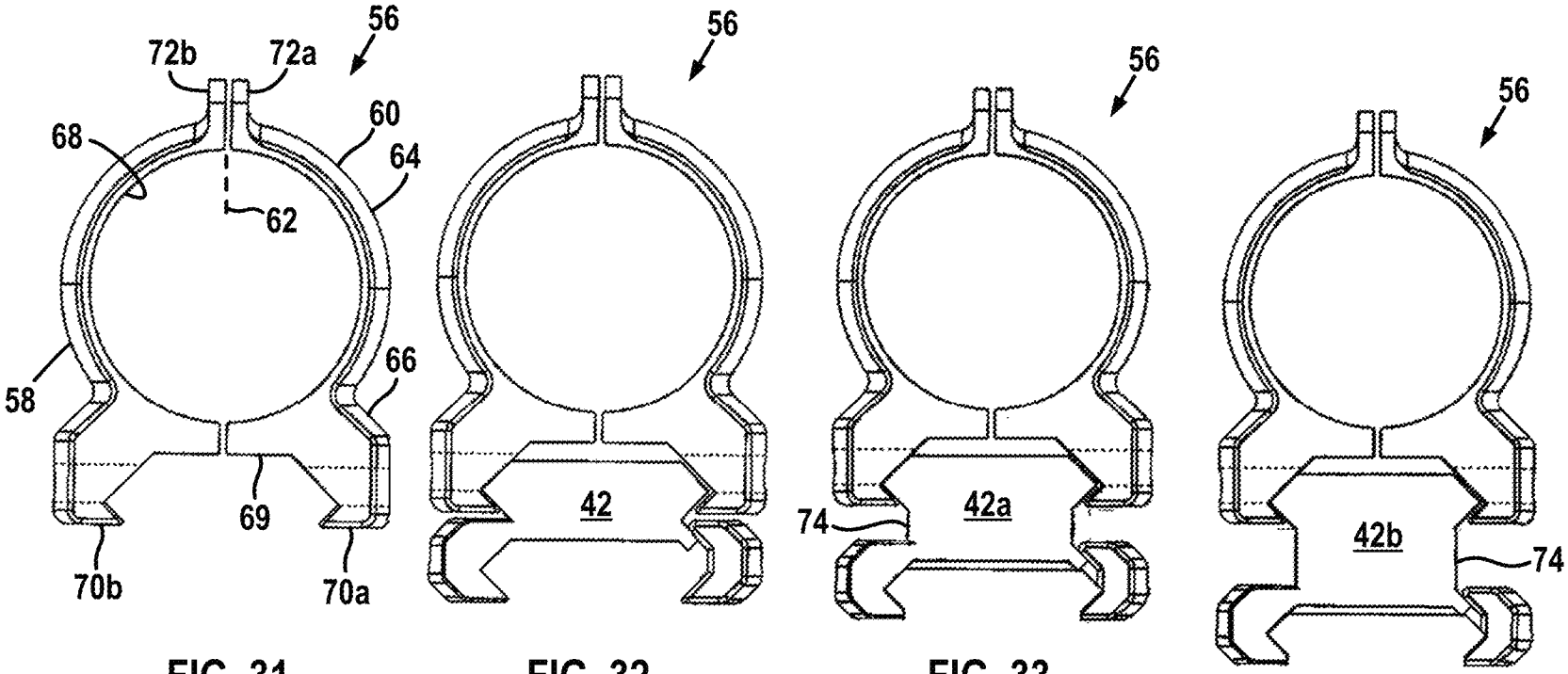
FIGS. 31 and 32 are front views of a second embodiment, single-base scope ring in accordance with this disclosure mounted on a mounting rail, the scope ring as shown in FIG. 32 reversed vertically on the mounting rail from FIG. 31.
FIGS. 33 and 34 are similar to FIGS. 31 and 32 but illustrate the scope ring mounted on an auxiliary rail that is mounted directly on the mounting rail

FIG. 31 illustrates a second embodiment scope ring 56 in accordance with this disclosure. The scope ring 56 includes a left component half 58 and a right component half 60 that each extend along a vertical parting plane 62 similar to the parting plane 30. The component halves 58, 60 cooperatively define a body 64 and a base 66. The body 64 defines a scope through-hole 68 like the through-hole 14 that receives the body tube of a rifle scope. The base 66 is disposed on one side of the through-hole 68 and extends radially away from the body. The base 66 is similar to the base 16 and has a flat surface 69 like the flat surface 22 and arms 70*a*, 70*b* (like the arms 20*a*, 20*b*) extending away from the body. The component halves are connected together by screws (not shown) passing through the base 66 as previously described with respect to the base 16 and through facing flanges 72 on the side of the body 64 opposite the base 66.

The base 66 retains and secures the scope ring 56 to a compatible rail R in the same manner as does the base 16. The scope ring 56 when attached to the rail R defines a first scope ring height. As shown in FIGS. 32-34 respectively, the auxiliary rail 42 or variant embodiment auxiliary rails 42*a* and 42*b* can be received in the base 66 to attach the scope ring 56 to the rail. The auxiliary rail 42*a* and the auxiliary rail 42*b* each includes a spacer 74 disposed between the rail 44 of the auxiliary rail and the base 43 of the auxiliary rail that spaces the rail 44 away from the base 43.

The scope ring 56 used without an auxiliary rail as shown in FIG. 31 when attached directly onto the rail R defines a low scope ring height. The scope ring 56 when attached indirectly onto the rail R by being attached to one of the auxiliary rails 42, 42*a*, and 42*b* attached directly onto the rail R as shown in FIGS. 32-34 respectively cooperatively define a medium scope ring height, a high scope ring height, and an extra-high scope ring height respectively.

FIGS. 31-34 illustrate a scope ring system consisting of a single-base scope ring 56 and a set of three auxiliary rails 42, 42*a*, 42*b* used to attach the scope ring 152 to a rail R at a low scope ring height, a medium scope ring height, a high scope ring height, and an extra-high scope ring height respectively.

A retailer need only stock a scope ring system that includes scope ring 56 and the three different height auxiliary rails: the short auxiliary rail 42, the taller auxiliary rail 42*a*, and the tallest auxiliary rail 42*b* to offer a single scope ring that can be selectively attached to a compatible mounting rail at four different scope ring heights. A customer can purchase a kit that includes the scope ring 56 and the three different-height auxiliary rails to enable attaching the scope ring 56 to a mounting rail at low, medium, high, and extra-high scope heights.

Figure 35:
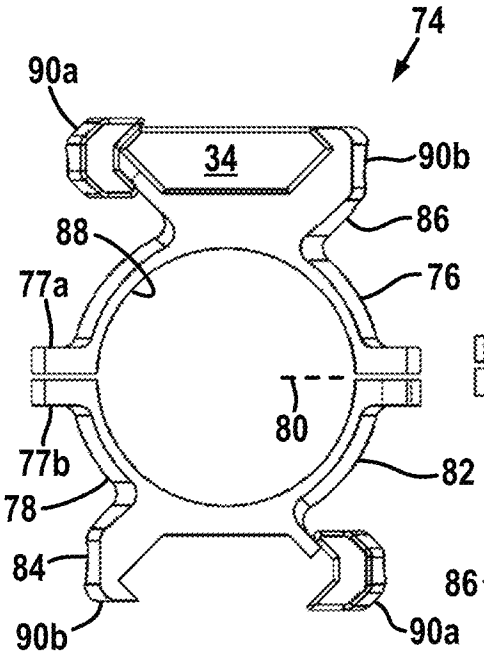
Figure 42:
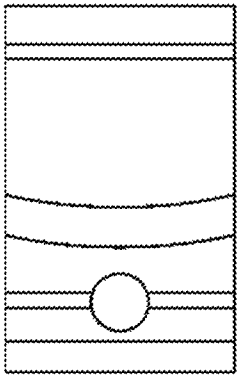
FIGS. 39-42 are perspective, front, bottom, and side views respectively of a portion of the upper component half of the scope ring shown in FIG. 35.
Figure 39:
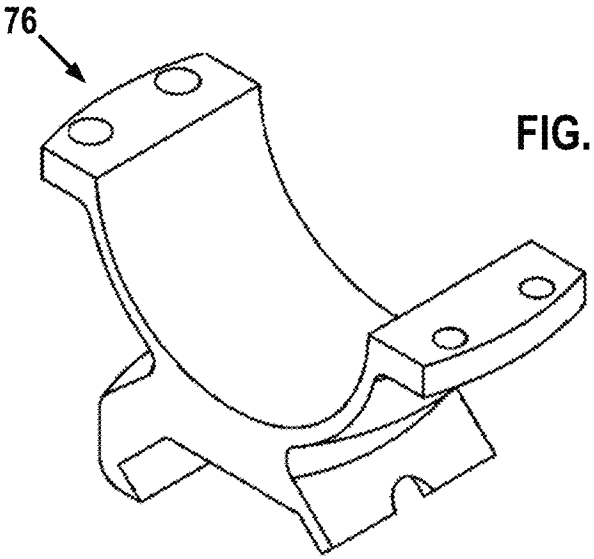
Figure 40:
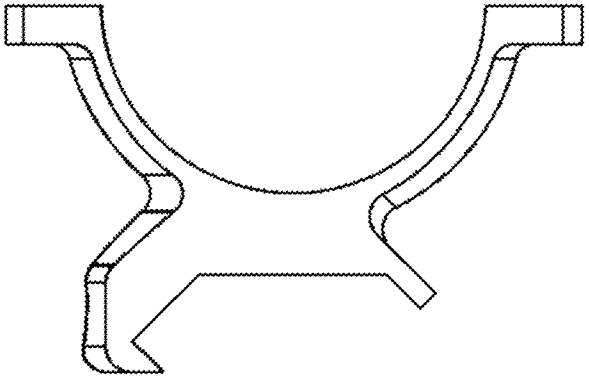
Figure 41:
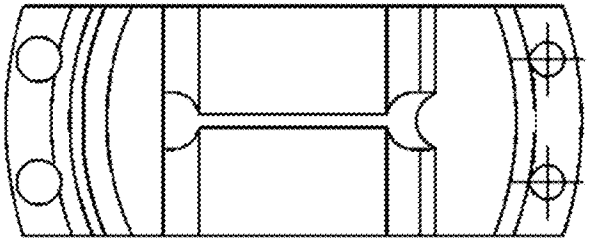
Figure 46:
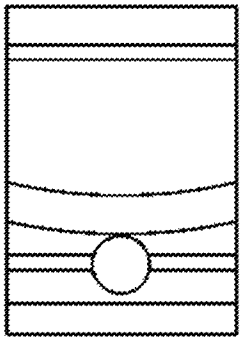
FIGS. 43-46 are perspective, front, bottom, and side views respectively of a portion of the lower component half of the scope ring shown in FIG. 35.
Figure 43:
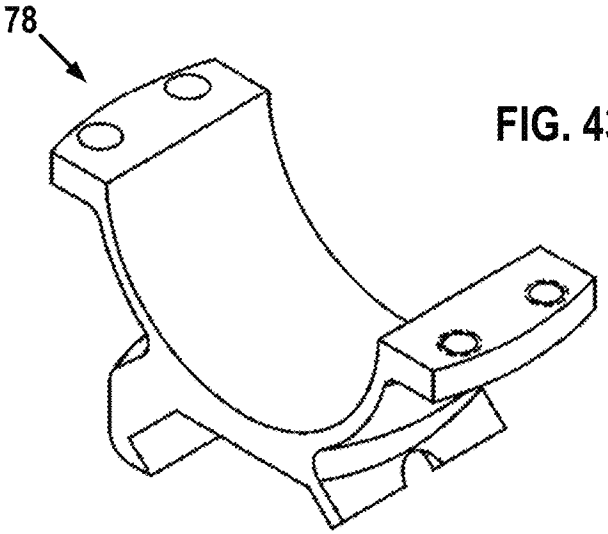
Figure 44:
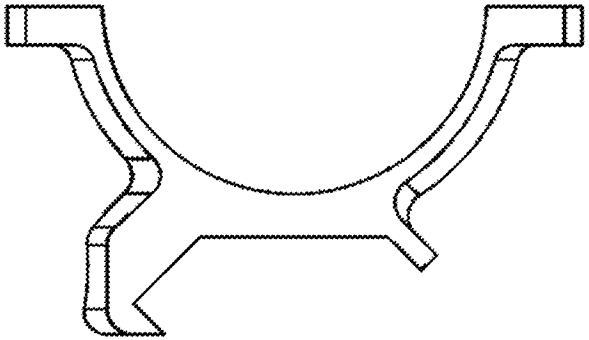
Figure 45:
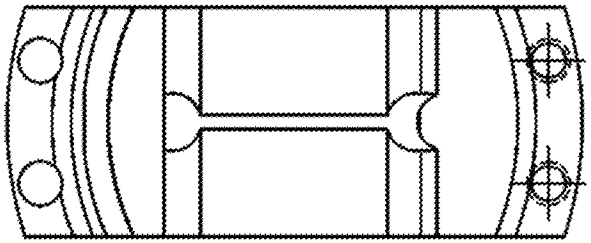

FIG. 35 illustrates a third embodiment scope ring 74 in accordance with this disclosure. The scope ring 74 is similar but not identical to the scope ring 10 shown in FIG. 1. The scope ring 74 include a first upper component half 76 (shown separately in FIGS. 39-42) and a second lower component half 78 (shown separately in FIGS. 43-46) that extend along a horizontal parting plane 80. The parting plane 80 is parallel with the rail when the scope ring 74 is attached to the rail. Cooperating flanges 72 receive a screw to fasten the component halves together in addition to the base screw.

The component halves 76, 78 define a body 82 and a first base 84 and a second base 86 disposed on opposite sides of the body. The body defines a circular scope through-hole 88 like the scope through-hole 14 that closely receives the body tube of a rifle scope.

The bases 84, 86 are similar to the bases 16, 18 respectively but are each formed as a two-component base. Because the scope ring 74 separates along a horizontal plane 80, the bases 84, 86 are each formed as a two-component base similar to the auxiliary rail 42 in having one arm 90*a* removably attached to the remainder of the base that includes the second arm 90*b*.

Figure 36:
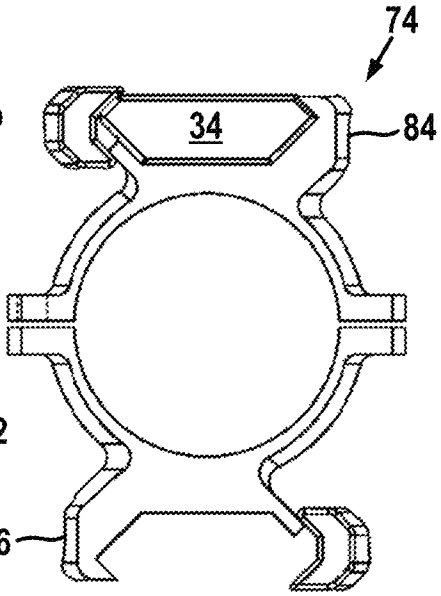
FIGS. 35 and 36 are front views of a third embodiment, two-base scope ring in accordance with this disclosure mounted on a mounting rail, the scope ring as shown in FIG. 36 reversed vertically on the mounting rail from FIG. 35.

Like the scope ring 10, when the scope ring first base 84 attaches the scope ring 74 directly onto the rail R (see FIG. 35), the scope ring 74 defines a first scope ring height above the mounting rail, and when the second base 86 attaches the scope ring directly onto the rail R (see FIG. 36), the scope ring 74 defines a second scope ring height above the mounting rail greater than the first scope ring height.

Figure 38:
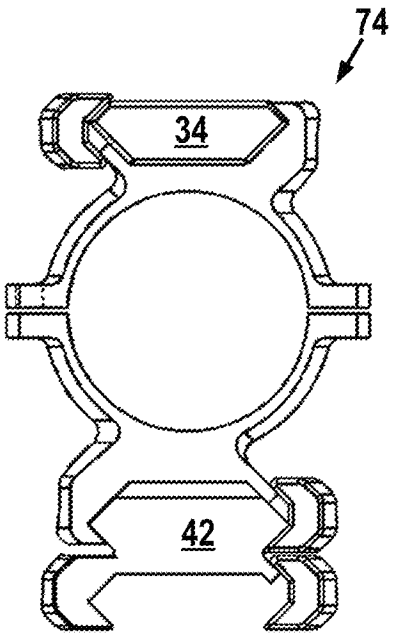
FIGS. 37 and 38 are similar to FIGS. 35 and 328 but illustrate the scope ring mounted on an auxiliary rail that is mounted directly on the mounting rail
Figure 37:
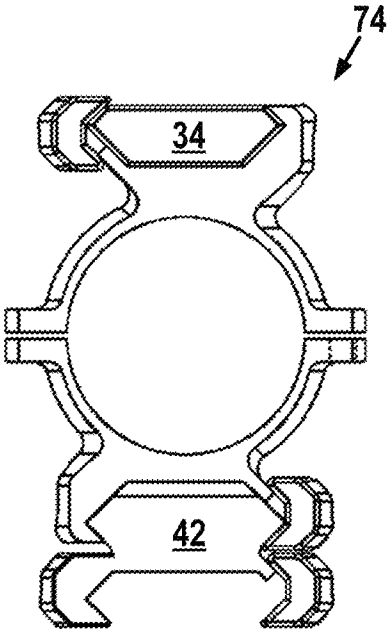

FIGS. 37 and 38 illustrate the scope ring 74 attached directly onto the auxiliary rail 42 which in turn is attached directly onto the rail R. FIGS. 37 and 38 illustrate the scope ring bases 84 and 86 attaching the scope ring 74 to the auxiliary rail 42 respectively. FIG. 37 illustrates the scope ring 74 defining a third scope ring height above the mounting rail. FIG. 38 illustrates the scope ring 74 defining a fourth scope ring height above the mounting rail.

The scope ring 74 is sized to define a low scope ring height and a medium scope ring height when attached directly onto the mounting rail without an auxiliary rail 42, and to define a high scope ring height and an extra-high scope ring height when indirectly attached to the mounting rail R by the auxiliary rail 42 being attached directly onto the mounting rail R.

A retailer need only stock scope rings 74 and auxiliary rails 42 to offer a scope ring system of a scope ring and an auxiliary rail that can be used for selectively attaching the scope ring to a compatible mounting rail at all four standard scope ring heights. The retailer can sell consumers a scope ring kit that includes the scope ring 74 and an auxiliary rail 42 to enable attaching the scope ring 74 to a mounting rail at low, medium, high, and extra-high scope heights.

Figure 47:
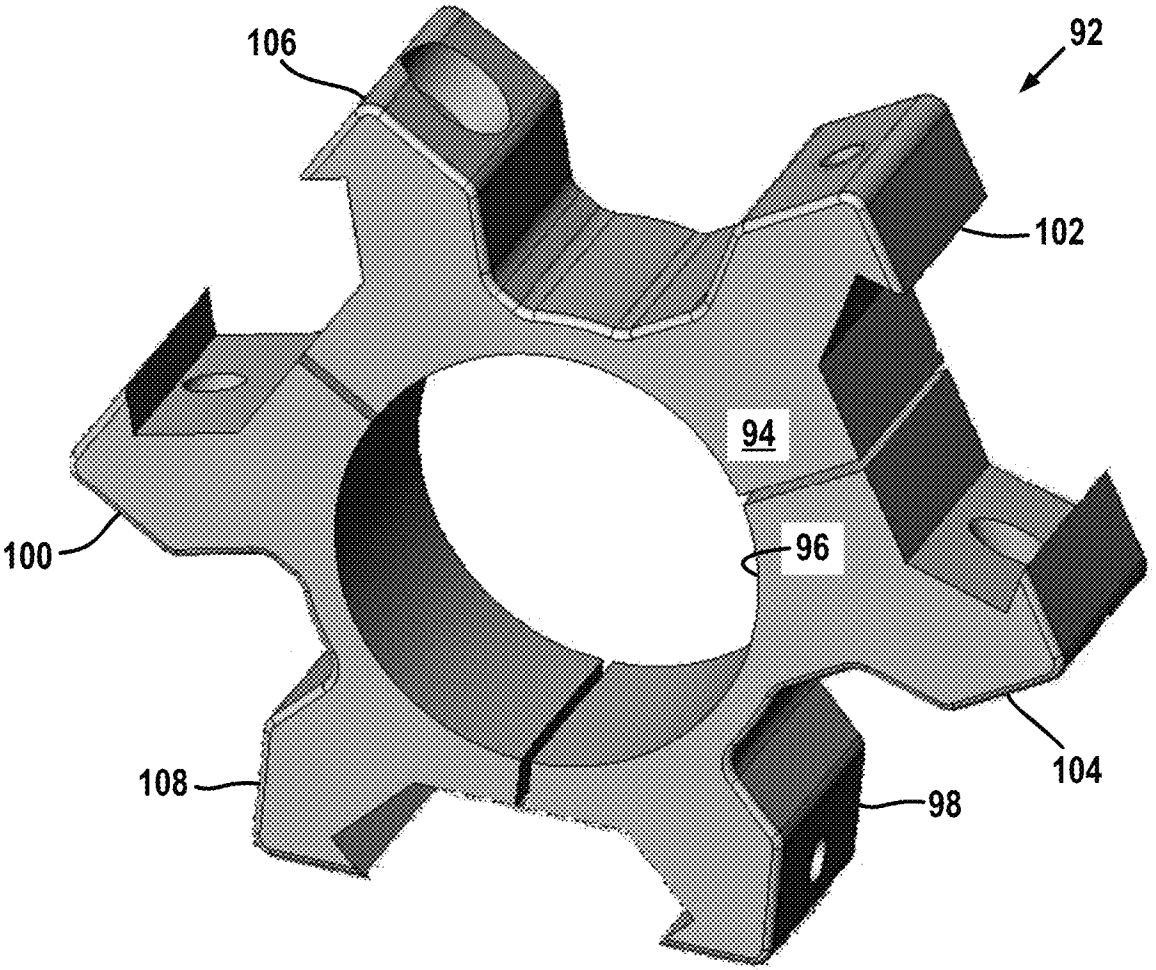
FIG. 47 is a perspective view of a fourth embodiment, three-base scope ring in accordance with this disclosure.

FIG. 47 illustrates a fourth embodiment scope ring 92 in accordance with this disclosure. The scope ring 92 has a body 94 that defines a through-hole 96 to closely receive the body tube of a rifle scope. Spaced circumferentially apart along the outside of the body 94 are more than two bases. The scope ring 92 shown in the figure has three bases: a base 98 that defines a first, lowest, scope ring height, a base 100 that defines a second, intermediate, scope ring height, and a base 102 that defines a third, highest, scope ring height of the scope ring 92. In the illustrated embodiment the base 98 defines a low scope ring height, the base 100 defines a medium scope ring height, and the base 102 defines a high scope ring height when attaching the scope ring 92 directly onto the rail R.

The scope ring 92 is formed as a multi-component member in which each component part either includes an entire base or includes portions of an adjacent pair of bases. The scope ring 92 has three component parts that include portions of adjacent pairs of bases: a first component part 104 that includes portions of the base 98 and the base 102, a second component part 106 that includes portions of the base 102 and the base 100, and a third component part 108 that includes portions of the base 100 and the base 98. The component parts are attached together by screws (not shown) extending through and threaded into the adjacent base arms of the component parts in a manner similar to a screw extending through the base arms of the scope ring 10. The screw passing through the base attaching the scope ring 92 to the rail of a mounting rail or auxiliary rail pass through a slot in the rail.

Embodiments of the scope ring 92 in which each component part includes a base may include each base having a removable arm that enables attaching the base to a rail of the mounting rail or auxiliary rail.

The scope ring 92 can also be used with an auxiliary rail such as one of the auxiliary rails 42, 42*b*, 42*c*, and 120 (discussed below) to provide additional scope ring heights in cooperation with the first base 104, the second base 106, and the third base 108. For example, the medium scope ring base 100 attached directly onto an auxiliary rail 42 that in turn is attached directly onto the rail R defines an extra-high scope ring height.

An auxiliary plug such as the auxiliary plug 34 or the auxiliary plug 52 can be held in the bases that are not being used to attach the scope ring 92 to a rail of the mounting rail or auxiliary rail.

A retailer need only stock the three-base scope ring 92 to offer a scope ring that can selectively attach a scope directly onto a rail R at three different scope ring heights. The retailer need only stock that includes the three-base scope rings 92 and auxiliary rails 42 to offer a scope ring system that can selectively attach a scope onto a rail R at all four standard scope heights. A customer can purchase a kit that includes the scope ring 92 and an auxiliary rail 42 to enable attaching the scope ring 92 to a mounting rail at low, medium, high, and extra-high scope heights.

Figure 49:
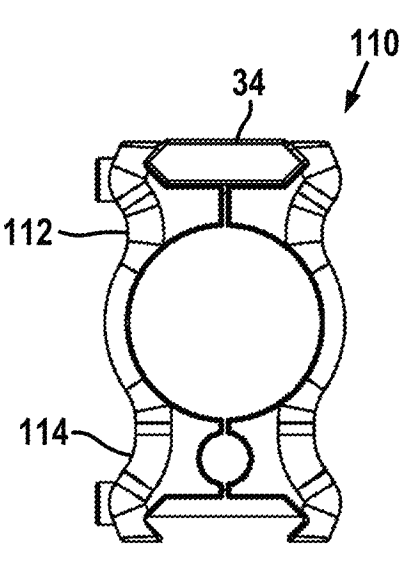
FIGS. 48 and 49 are front views of a fifth embodiment, two-base scope ring in accordance with this disclosure mounted on a mounting rail, the scope ring as shown in FIG. 49 reversed vertically on the mounting rail from FIG. 48.
Figure 48:
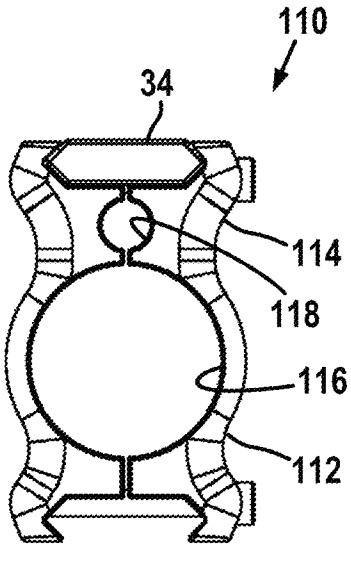
Figure 52:
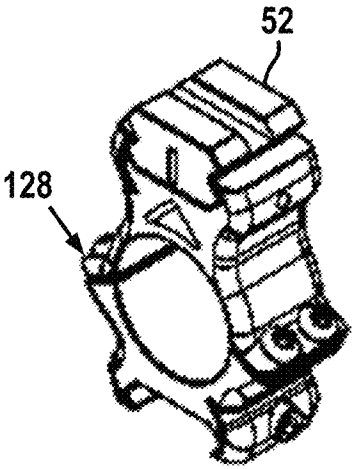
FIG. 52 is a perspective view of a sixth embodiment, two-base scope ring in accordance with this disclosure.

FIGS. 48 and 49 illustrate a fifth embodiment scope ring 110 carrying an auxiliary plug 34. The scope ring 110 is similar to the scope ring 10 in being a two-base, two-component scope ring joined along a vertical parting plane and so only the differences will be discussed. The scope ring 110 has a first base 112 like the base 16 defining a first, lower scope ring height and a second base 114 like the base 16 defining a second, greater scope ring height. Because the second base 114 extends further away from the circular scope through-hole 116, there is sufficient material to place an auxiliary through-hole 118 in the second base 112. The parting plane extends through the center of the through-hole 118. Thus the auxiliary through-hole 118 can serve four different purposes:

(a) reducing the weight of the assembled scope ring 110;
(b) easing assembly of the component parts of the scope ring 110 by matching the hole portions to assure correct initial positioning of the component parts;
(c) enabling the scope ring 110 when assembled to clamp an additional auxiliary (such as a laser targeting module) extending through the auxiliary through-hole 118 or a pair of aligned auxiliary through-holes 118; and
(d) enabling a user to quickly identify the different bases of the scope ring 110.

In variant embodiments, the auxiliary through-hole 118 can be formed as a non-circular through-hole to form a non-rotatable connection between the scope ring and a compatible auxiliary extending through the auxiliary through-hole.

Figure 51:
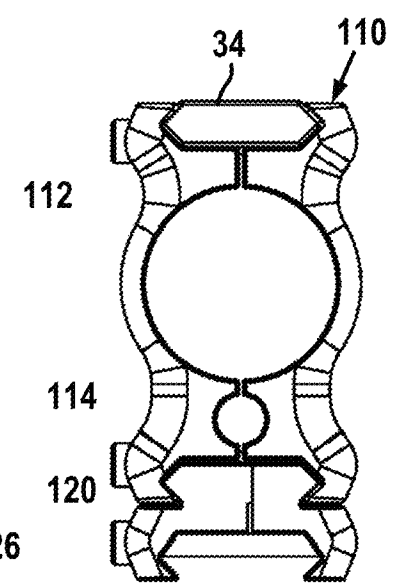
FIGS. 50 and 51 are similar to FIGS. 48 and 49 but illustrate the scope ring mounted on an auxiliary rail that is mounted directly on the mounting rail
Figure 50:
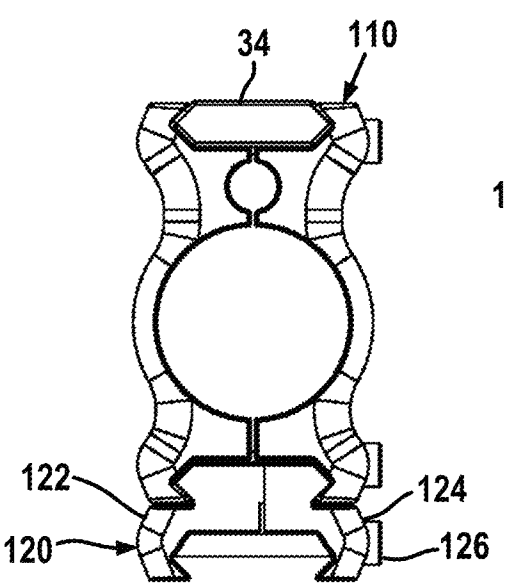

FIGS. 50 and 51 illustrate the scope ring 110 mounted directly upon an auxiliary rail 120 that in turn is directly mounted on a mounting rail The auxiliary rail 120 is similar to and interchangeable with the auxiliary rail 42. The auxiliary rail 120 is a two-component member, having a right arm component 122 and a left arm component 124. Each arm component carries a respective arm of the auxiliary rail. The components are assembled using a screw 126 fastening the components together that would pass through a slot in the rail R to attach and locate the auxiliary rail 120 along the rail R.

FIGS. 48-51 illustrate a scope ring system consisting of the scope ring 110 and the auxiliary rail 120 that is capable of attaching the scope ring 110 to a rail R at a low scope ring height, a medium scope ring height, a high scope ring height, and an extra-high scope ring height respectively.

A retailer need only stock scope rings 110 and auxiliary rails 42 and/or auxiliary rails 120 to offer a scope ring system of a scope ring and an auxiliary rail that can be used for selectively attaching the scope ring to a compatible mounting rail at all four standard scope ring heights. The retailer can sell consumers a scope ring kit that includes the scope ring 110 and an auxiliary rail 42 or auxiliary rail 120 to enable attaching the scope ring 110 to a mounting rail at low, medium, high, and extra-high scope heights.

FIGS. 52-56 illustrate a seventh embodiment two-base scope ring 128 carrying an auxiliary plug 34. The scope ring 128 is similar to third embodiment scope ring 74 in being a multi-component scope ring in which each component 130, 132 respectively includes a base: the component 130 includes a first, short base 134 similar to the base 84 and the component 132 includes a second, taller base 136 similar to the base 86. In this embodiment the components 130, 132 define a pair of parting planes 138*a*, 138*b* inclined with respect to one another on opposite sides of the scope through-hole 140. The components are releasably fastened to one another by a first pair of screws 142 and a second pair of screws 144 extending through respective parting planes.

The scope ring 128 includes a visible indicia 146 formed as a recess on each of the opposite facing sides of the taller base 136. The illustrated indicia is arrow-shaped and oriented to point to the rail when the base 136 is attaching the scope ring 128 to a compatible rail. The indicia 146 reduces the weight of the assembled scope ring 128 and enables a user to quickly differentiate between bases of the scope ring 128.

Like the third embodiment scope ring 74, no component parting plane separates the pair of arms associated with each base. Each base 134, 136 of the scope ring 128 is formed as a two-component base similar to the corresponding bases of the scope ring 74 previously described above.

Figure 56:
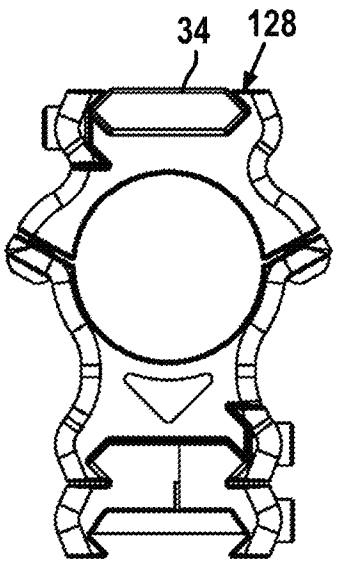
FIGS. 55 and 56 are similar to FIGS. 53 and 54 but illustrate the scope ring mounted on an auxiliary rail that is mounted directly on the mounting rail
Figure 55:
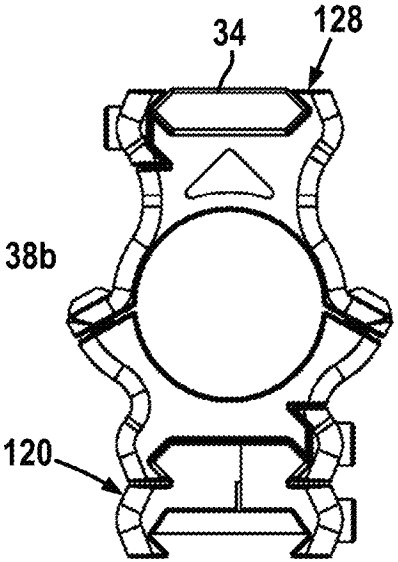
Figure 54:
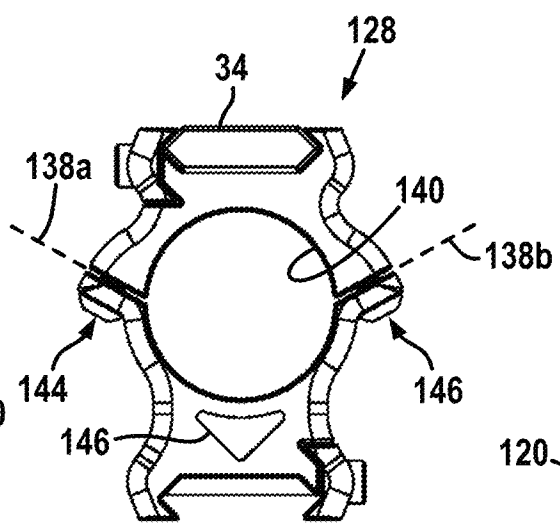
FIGS. 53 and 54 are front views of the scope ring shown in FIG. 52 mounted on a mounting rail, the scope ring as shown in FIG. 54 reversed vertically on the mounting rail from FIG. 53.
Figure 53:
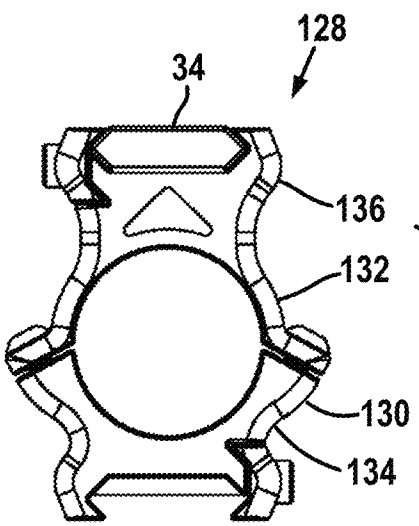

FIGS. 55 and 56 illustrate the scope ring 128 attached directly onto an auxiliary rail 120 attached directly onto the rail R. The scope ring 128 is shown in the figures attached to the auxiliary rail 120 by the shorter scope ring base 134 and by the taller scope ring base 136 respectively.

FIGS. 53-56 illustrate a scope ring system consisting of the scope ring 128 and the auxiliary rail 120 capable of attaching the scope ring 128 to a rail R at a low scope ring height, a medium scope ring height, a high scope ring height, and an extra-high scope ring height respectively.

A retailer need only stock scope rings 128 and auxiliary rails 42 and/or auxiliary rails 120 to offer a scope ring system of a scope ring and an auxiliary rail that can be used for selectively attaching the scope ring to a compatible mounting rail at all four standard scope ring heights. The retailer can sell consumers a scope ring kit that includes the scope ring 128 and an auxiliary rail 42 or auxiliary rail 120 to enable attaching the scope ring 110 to a mounting rail at low, medium, high, and extra-high scope heights.

Figure 58:
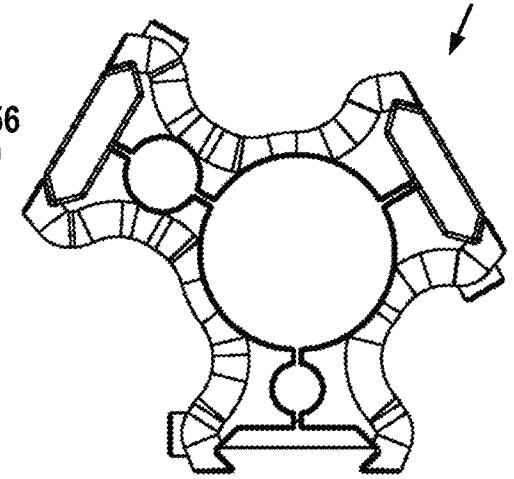
FIGS. 57-59 are front views of a seventh embodiment, three-base scope ring in accordance with this disclosure, the scope ring mounted to the mounting rail by different bases of the scope ring.
Figure 57:
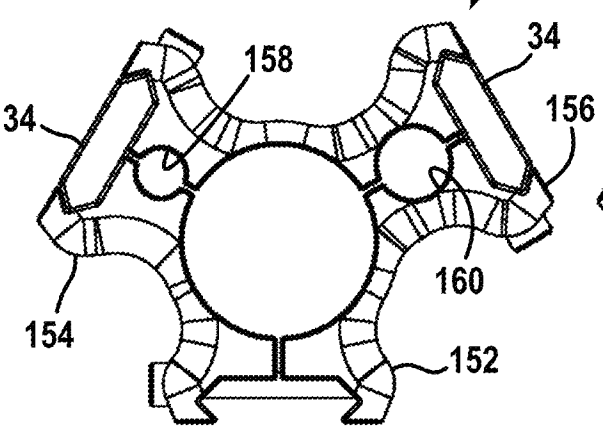
Figure 60:
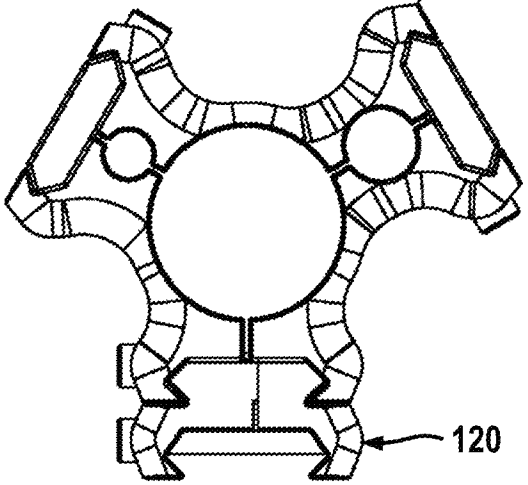
FIG. 60 is similar to FIG. 53 but illustrates the scope ring mounted on an auxiliary rail that is mounted directly on the mounting rail.
Figure 59:
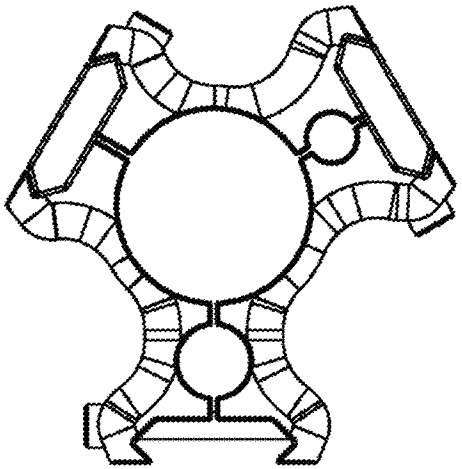
Figure 71:
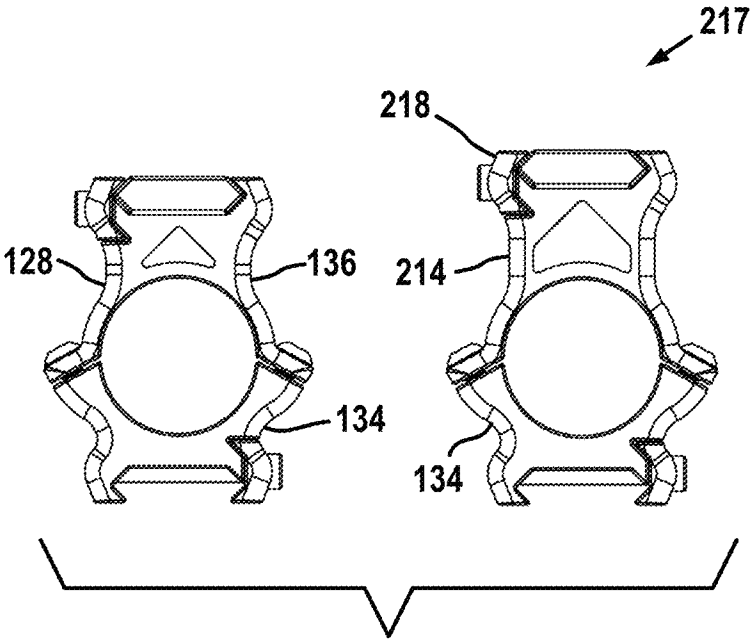
FIG. 71 illustrates a different scope ring kit made up of a pair of two-base scope rings having interchangeable components.

FIGS. 57-60 illustrate an eighth embodiment scope ring 150. The scope ring 150 is similar to the fourth embodiment scope ring 92 in being a three-base, three-component scope ring. The scope ring 150 includes a first, short base 152, a second, greater height base 154, and a third, yet greater height base 156. FIGS. 58-60 illustrate the scope ring 150 attached directly onto a rail R by the base 152 and defining a low scope ring height, the base 154 and defining a medium scope ring height, and the base 156 and defining a high scope ring height respectively, with auxiliary plugs 34 held in the bases not attaching the scope ring 150 to the rail R.

The scope ring 150 includes a first auxiliary through-hole 158 like the auxiliary through-hole 118 formed in the medium base 154, and a larger diameter second auxiliary through-hole 160 formed in the high base 156. Parting planes defined by the three scope ring components extend through the center of each of the auxiliary through-hole 158 and the auxiliary through-hole 160, enabling the auxiliary through-holes 158, 160 to offer the same benefits of the auxiliary through-hole 118 set forth above.

The retailer need only stock a scope ring system that includes the three-base scope ring 150 to offer a scope ring that can selectively attach a scope directly onto a rail R at three different scope ring heights. The retailer need only stock the three-base scope rings 150 and auxiliary rails 42 and/or auxiliary rails 120 to offer a scope ring system that can selectively attach a scope onto a rail R at all four standard scope heights. A customer can purchase a kit that includes the scope ring 150 and an auxiliary rail 42 or auxiliary rail 120 to enable selectively attaching the scope ring 92 to a mounting rail at all four standard scope heights.

FIGS. 61-69 illustrate three different versions of a ninth embodiment, single-base, multi-component scope ring 170 that can replace the single-base scope ring 56 in a scope ring system that includes one or more auxiliary rails. The scope ring 170*a* shown in FIG. 61 defines a low scope ring height when mounted directly on a rail R, the scope ring 170*b* shown in FIG. 64 defines a medium scope ring height, and the scope ring 170*c* shown in FIG. 67 defines a high scope ring height.

Each scope ring 170 includes an upper component half 172 and a lower component half 174 that cooperatively define a circular scope through-hole 176. The lower component half 174 defines a base 178 that includes a pair of arms 180*a*, 180*b* that attach the scope ring 170 onto the rail R of a mounting rail or the rail of an auxiliary rail 42, 120 as previously described.

The upper component half 172 and the lower component half 174 meet and are removably attached to one another along a pair of inclined parting planes 182*a*, 182*b* located on opposite sides of the scope through-hole 176 and extending radially from the half of the scope through-hole 176 adjacent to the base 178.

The upper component half 172 is a multi-component member formed from a right upper component half 184 and a left upper component half 186. The upper ends of the upper component halves 182, 184 cooperatively define a pivotal hinge joint 188 that receives a hinge pin 190 that defines the pivot axis or axis of the hinge joint 188. The hinge pin 190 extends parallel to the rail when the scope ring 170 is attached onto a rail.

The upper component halves 184, 186 are pivotable with respect to one another about the hinge pin 190 when the upper component halves 184, 186 are not both attached to the lower component half 174. It allows for a more compact design. The hinged upper component half 172 extends more than 180 degrees around a scope held by the scope ring 170 instead of just 180 degrees as in conventional single-base scope ring designs, and enables a much slimmer scope ring profile.

The lower component half 174 is also a multi-component member that includes a right lower component 192 and a left lower component half 194. Each lower component half 192, 194 carries a respective arm 180. The lower component halves 192, 194 are connected by a screw 196 in the same manner as the screw 126 connecting the component halves of the auxiliary rail 120. The screw 196 extends through a slot of a rail when the base 178 attaches the scope ring 170 to the rail. The medium scope height and high scope height embodiments of the scope ring 170 include an additional screw 198 spaced above the screw 196 away from the arms for additional horizontal clamping force urging the lower component halves 192, 194 together.

Each lower component half 192, 194 include an outer inclined bearing surface 200 that extends from the associated leg to the upper curved surface defining a portion of the scope through-hole 176 and facing respective parting planes 182*a*, 182*b*. The upper component halves 184, 186 include radially extending flanges 202 at their free ends that bear against the lower component halves bearing surfaces 200 and receive pairs of screws 204, 206 that fixedly and removably attach the upper component half 172 to the lower component half 174.

A retailer need only stock a scope ring system that includes the shortest height scope ring 170 and three different height auxiliary rails 42 or auxiliary rails 120 as previously described with respect to the scope ring 56 to offer a single scope ring that can be selectively attached to a compatible mounting rail at four different scope ring heights. A customer can purchase a kit that includes the scope ring 170 and the three different-height auxiliary rails to enable attaching the scope ring 170 to a mounting rail at low, medium, high, and extra-high scope heights.

In addition to scope ring systems that include multi-base scope rings and auxiliary rails usable in combination to provide all four standard scope ring heights, a dealer could stock different pairs of multi-base scope rings that provide for all four standard scope ring heights by attaching the desired scope ring base directly onto the mounting rail. A customer can buy a kit that includes two different multi-base scope rings that enables selectively mounting a scope ring to a mounting rail at the four standard scope heights.

Figure 70:
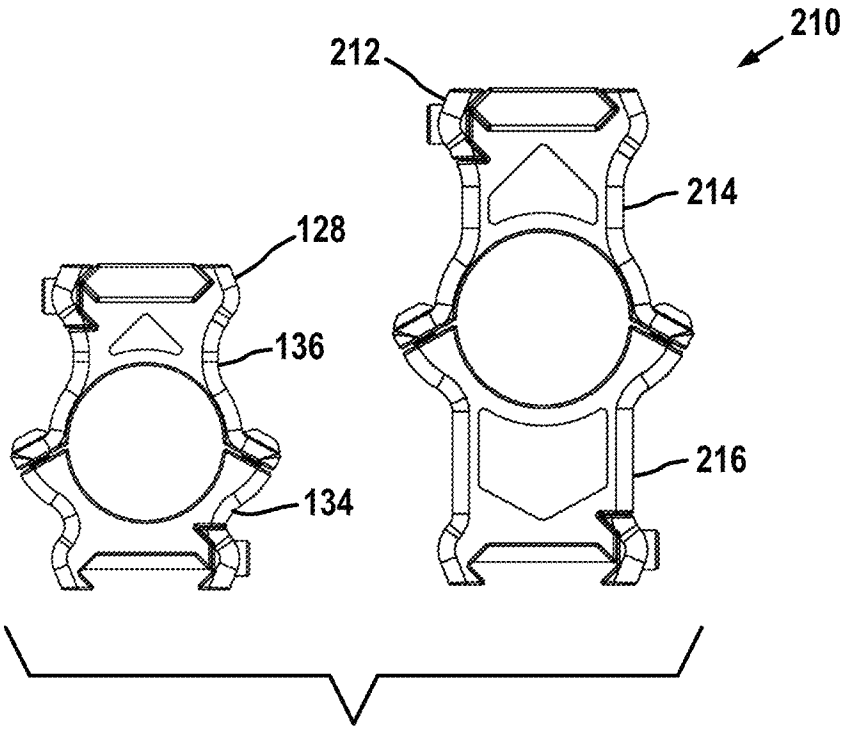
FIG. 70 illustrates a scope ring kit made up of a pair of two-base scope rings in accordance with this disclosure.

FIG. 70 illustrates a scope ring kit 210 made up of a scope ring 128 described above and a similar scope ring 212 (both scope rings are shown also carrying auxiliary plugs). The scope ring 128 has a shorter base 134 and a taller base 136 that respectively define low and medium scope heights when attaching the scope ring 212 directly onto a mounting rail. The scope ring 212 includes a relatively shorter base 214 and a relatively greater height base 216 that respectively define high and extra-high scope ring heights when attaching the scope ring 212 directly onto a mounting rail.

A retailer need only stock the scope ring 128 and the scope ring 212 to offer scope rings that can be selectively attached to a compatible mounting rail at four different scope ring heights. A customer can purchase a kit that includes the scope ring 128 and the scope ring 212 to enable selectively attaching a scope ring to a mounting rail at low, medium, high, and extra-high scope heights. The kit could be made of a pair of two-base scope rings having different combinations of the low, medium, high, and extra-high bases than the illustrated low-medium and high-extra-high base pairs.

Figure 72:
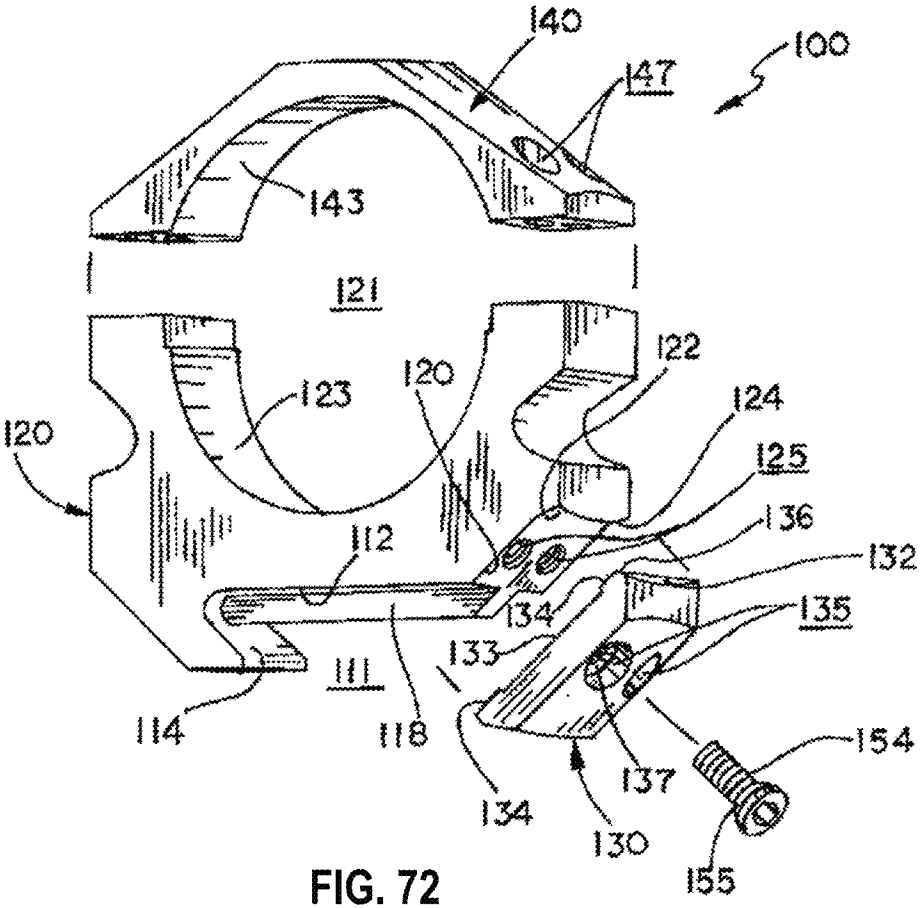
FIG. 72 PRIOR ART
FIG. 72 illustrates a prior art assembly for attaching a removable arm to a scope ring.
Figure 73:
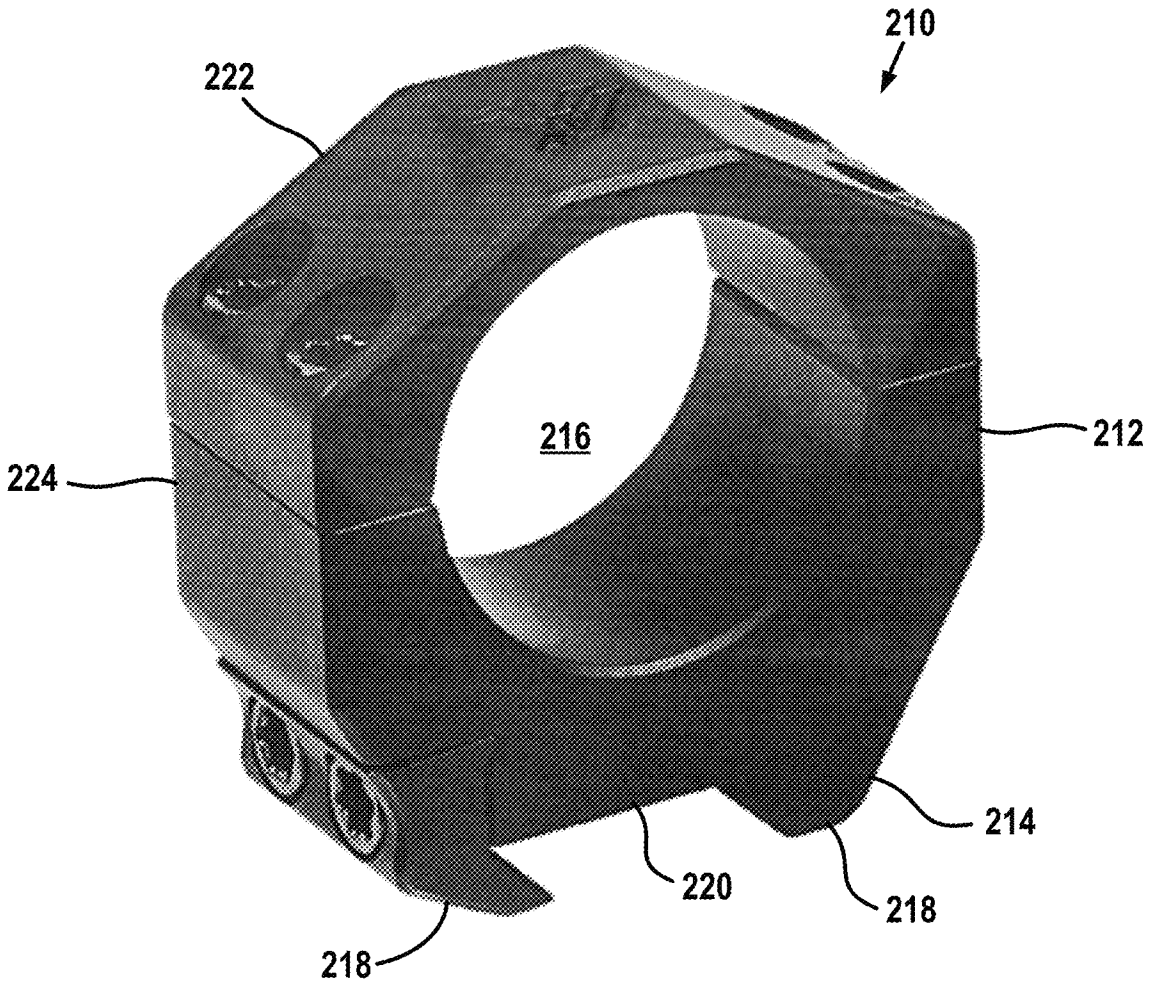
FIG. 73 PRIOR ART
FIG. 73 illustrates a prior art scope ring.

FIG. 72 illustrates in part a different scope ring system 217 that also enables attaching a scope ring to a mounting rail at low, medium, high, and extra-high scope heights. The figure illustrates the previously described scope ring 128 having bases 134, 136, and a similar scope ring 218. Both the scope ring 128 and the scope ring 218 include auxiliary plugs. The scope ring 218 includes the same base 134 of the scope ring 128 and the same base 214 of the scope ring 212 shown in FIG. 61. That is, the component halves that include the base 136 and the base 214 are both interchangeably attachable to the component half that contains the base 134. Similarly the component half that contains the base 216 of the scope ring 212 can be designed to also be interchangeably attachable with the component half that contains the base 134. Different scope ring heights can be made available by selectively swapping out or otherwise attaching different bases, such as the bases 136, 212, and 214 to the base 134.

A retailer need only stock interchangeable stock ring components that include and define different height scope ring bases to enable assembling scope rings that enable mounting a scope to a mounting rail at either of the four standard scope heights. A customer can purchase a kit of stock ring component parts that include the bases of interest to enable the customer to mount a scope ring at different scope ring heights onto a mounting rail.

The scope ring components with the respective bases can also be designed to be fully interchangeable and attachable with each other.

An auxiliary rail that increases the scope height of an attached scope ring by 0.1 inches can be used alone or stacked with other auxiliary rails and attached to a rail R for mounting a scope ring indirectly onto the rail R at an increased scope height. The shorter auxiliary rail can be used for example with a two-base scope ring that defines a low scope height and a high scope height when directly attached to a rail R to enable the scope ring to be indirectly attached to the rail R at medium and extra-high scope heights.

Other base attachment mechanisms that enable the base of a scope ring or auxiliary rail to be attached to a rail of a mounting rail or auxiliary rail are known in the art and can be used or modified for use with the disclosed scope rings and auxiliary rails. For example, Joplin, US Patent Application Publication 2013/0283663 incorporated by reference as if fully set forth herein discloses a removable base arm attached to the remainder of the base by screws extending into the base. See FIG. 63, taken from Joplin FIG. 2.

Generally a pair of scope rings are attached to a mounting rail to mount a scope suspended between the scope rings. A user would normally obtain a like pair of the disclosed scope rings or a like pair of the disclosed kits for use in mounting the scope to the mounting rail.

While this disclosure includes one or more illustrative embodiments described in detail, it is understood that the one or more embodiments are each capable of modification and that the scope of this disclosure is not limited to the precise details set forth herein but include such modifications that would be obvious to a person of ordinary skill in the relevant art including (but not limited to) changes in material selection, size, ring heights and ranges of ring heights established by the scope ring base, base configuration for mounting to other mounting rail systems (whether on long guns, crossbows, or other armaments), use or non-use of auxiliary plugs, use of auxiliary plugs or auxiliary rails having different auxiliary mounting configurations or attachment mechanisms, and the like.

What is claimed is:

1. A scope ring for attaching a scope to a mounting rail of an armament, the scope ring comprising:

a scope through-hole being configured to receive a portion of the scope;

a first base and a second base, each of the first base and the second base comprising a pair of arms being configured to receive and directly attach the base onto a rail of the mounting rail;

the scope ring having only the first base and the second base;

a first component member and a second component member, the first and second component members being removably fastenable to one another to form the scope ring, the first component member comprising the first base and the second component member comprising the second base;

the first and second component members surrounding and extending 360 degrees around the scope through-hole when the first and second component members are forming the scope ring;

one of the first and second component members extending for more than 180 degrees around the scope through-hole of the scope ring; and each of the first base and the second base defining a respective first scope ring height and a second scope ring height when the base is attached onto the rail of the mounting rail, the second scope ring height defined by the second base being greater than the first scope ring height defined by the first base whereby the scope ring can be selectively attached onto the mounting rail at one of the first and second scope ring heights.

2. A scope ring for attaching a scope to a mounting rail of an armament, the scope ring comprising:

a plurality of rigid component members being releasably fastenable to one another to form the scope ring, the scope ring comprising a scope through-hole and a plurality of bases, the scope through-holebeing configured to receive a portion of a scope, the plurality of bases being spaced away from the scope through-hole and being circumferentially spaced apart from one another around the scope through-hole;

each base of the plurality of bases of the scope ring comprising a pair of arms being configured to receive and directly attach the base onto a rail of the mounting rail, each base of the plurality of bases defining a respective scope ring height that is different than the scope ring height defined by the one or more other bases of the plurality of bases of the scope ring whereby the scope ring can be selectively attached onto the mounting rail at a plurality of different scope ring heights with the scope ring being disposed in the scope through-hole;

each component member of the plurality of component members comprising a surface disposed as an outer surface portion of the component member, the surfaces of the plurality of rigid component members being of a predetermined configuration and defining and facing a scope through-hole of predetermined size when the plurality of rigid component members are fastened to one another and forming the scope ring; and each component member of the plurality of component members including two respective arms of the plurality of bases, each of the two respective arms being rigidly connected to the curved surface of the component member whereby the two respective arms are fixedly positioned relative to the curved surface when the component member is not attached to another component member of the plurality of component members.

3. The scope ring of claim 2 wherein the plurality of bases includes only a first base and a second base and the plurality of component members includes only a first component member and a second component member.

4. The scope ring of claim 3 wherein the first component member includes only the pair of arms of the first base and the second component member includes only the pair of arms of the second base whereby the scope ring can be selectively mounted onto a mounting rail at two different scope heights.

5. The scope ring of claim 4 wherein one arm of each of the first and second bases is fixedly attached to the component member associated with the base and a portion of the other arm of each of the first and second bases is a releasably fastened member of the other arm to enable mounting the base to and/or removing the base from the mounting rail.

6. The scope ring of claim 4 wherein the first and second component members each extend along one or more parting planes that do not extend between the arms of the bases when fastened together to form the scope ring.

7. The scope ring of claim 4 wherein the first base mounts the scope ring at a first scope ring height when mounting the scope ring atop a mounting rail and the second base mounts the scope ring at a second scope ring height when mounting the scope ring atop a mounting rail; and the scope ring comprises a third component member comprising a pair of arms of a third base, the third component member being interchangeably attachable with the first component member to form a second scope ring, the third base mounting the scope ring at a third scope height different from the first and second scope heights when the third base is mounting the second scope ring atop the mounting rail.

8. The scope ring of claim 3 wherein the first component member includes one first arm of the first base and one arm of the second base, and the second component member includes the other arm of the first base and the other arm of the second base.

9. The scope ring of claim 8 wherein the arms of each component member are permanently attached to the component member.

10. The scope ring of claim 8 wherein the first and second component members each extend along a parting plane extending between the arms of each base when the first and second component members are fastened together to form the scope ring.

11. The scope ring of claim 8 comprising a first fastener and a second fastener, the first and second component members being fastened together by the first fastener extending between the arms of the first base and by the second fastener extending between the arms of the second base when forming the scope ring.

12. The scope ring of claim 3 wherein the plurality of bases includes only three bases and the plurality of component members includes only three component members.

13. The scope ring of claim 12 wherein each component member of the three component members includes the arms of a respective base of the three bases.

14. The scope ring of claim 12 wherein the three component members are fastened together when forming the scope ring by a plurality of fasteners, each fastener of the plurality of fasteners extending between the arms of a respective base of the three bases of the scope ring.

15. The scope ring of claim 2 wherein the scope ring comprises indicia associated with at least one base that indicates the relative scope ring height associated with the base.

16. The scope ring of claim 15 wherein the indicia comprises surface indicia disposed on the scope ring.

17. The scope ring of claim 15 wherein the indicia comprises openings extending through the scope ring.

18. The scope ring of claim 2 wherein the pair of arms of each base of the plurality of bases is configured to clamp onto a Picatinny rail and/or a Weaver rail to mount the scope ring to the mounting rail.

19. The scope ring of claim 2 comprising a plurality of fasteners, wherein the plurality of component members are fastened together when forming the scope ring by the plurality of fasteners, each base being configured to receive a respective fastener of the plurality of fasteners that extends between the arms of the base when the plurality of fasteners are fastening together the plurality of component members.

* * * * *